US011793730B2

(12) United States Patent
Wynh et al.

(10) Patent No.: US 11,793,730 B2
(45) Date of Patent: Oct. 24, 2023

(54) RETRACTABLE PACIFIER SYSTEM

(71) Applicants: Jennifer Wynh, McKinney, TX (US); Olivia Blechschmidt, Livingstone, TX (US)

(72) Inventors: Jennifer Wynh, McKinney, TX (US); Olivia Blechschmidt, Livingstone, TX (US)

( * ) Notice: Subject to any disclaimer, the term of this patent is extended or adjusted under 35 U.S.C. 154(b) by 151 days.

(21) Appl. No.: 17/156,550

(22) Filed: Jan. 23, 2021

(65) Prior Publication Data

US 2022/0233408 A1 Jul. 28, 2022

(51) Int. Cl.
*A61J 17/00* (2006.01)

(52) U.S. Cl.
CPC ..... *A61J 17/113* (2020.05); *A61J 17/001* (2015.05)

(58) Field of Classification Search
CPC ..... A61J 17/001; A61J 17/113; A61J 17/00; A61J 17/02; A61J 17/10
See application file for complete search history.

(56) References Cited

U.S. PATENT DOCUMENTS

| | | | | |
|---|---|---|---|---|
| 3,363,630 | A * | 1/1968 | Hines | A61J 17/113 606/234 |
| 4,819,641 | A * | 4/1989 | Russell | A61J 17/113 606/234 |
| 5,366,481 | A | 11/1994 | Zade | |
| 9,198,836 | B1 | 12/2015 | Akinyelure | |
| 2002/0087191 | A1* | 7/2002 | Huang | A61J 17/113 606/236 |
| 2004/0088005 | A1 | 5/2004 | Boyd | |
| 2009/0108009 | A1* | 4/2009 | Yeung | A61J 9/00 215/11.2 |
| 2013/0331887 | A1* | 12/2013 | Subramanian | A61J 17/113 606/236 |
| 2014/0039553 | A1* | 2/2014 | Badger | A61J 17/001 606/236 |
| 2014/0257387 | A1* | 9/2014 | Saxton | A61J 17/113 606/236 |
| 2016/0296424 | A1* | 10/2016 | Eerden | A61J 17/113 |
| 2018/0235846 | A1 | 8/2018 | Fang et al. | |
| 2018/0256454 | A1* | 9/2018 | Badger | A61J 17/113 |

FOREIGN PATENT DOCUMENTS

| | | |
|---|---|---|
| JP | 2017500101 | 1/2017 |
| KR | 20010006221 | 1/2016 |

OTHER PUBLICATIONS

English machine translation of KR-20010006221 (Year: 2021).*
Joom, Newborn Infant baby pacifier teether retractable nipple, Nov. 12, 2020, URL: https://www.joom.com/en/products/5f0eed022d3ff50106001329.

* cited by examiner

*Primary Examiner* — Katherine M Shi
(74) *Attorney, Agent, or Firm* — John D. Tran; Rhema Law Group, P.C.

(57) ABSTRACT

A method and apparatus can include: a shield; a shaft coupled to the shield; a nipple coupled to the shaft; and a membrane coupled between the shield and the shaft, the membrane providing a retracted configuration creating a storage cavity for the nipple based on the shaft being pulled away from the shield, and the membrane providing an extended configuration with the nipple exposed and extended past the shield based on the shaft being pressed toward the shield and the membrane inverting from the retracted configuration.

14 Claims, 14 Drawing Sheets

RETRACTABLE PACIFIER SYSTEM

TECHNICAL FIELD

This disclosure relates to pacifiers, more particularly to pacifier systems employing retractable nipple elements.

BACKGROUND

Pacifiers are commonly used as an effective way to sooth and calm infants and young children. Pacifiers can be found in numerous shapes, sizes, and designs. Although there are many choices available, a common set of features is typically demanded by consumers.

Among these features, safety is the primary requirement. Many safety concerns can be addressed by the dimensions of the pacifier to prevent choking or allow for mouth breathing. Another consideration that continues to be an area of innovation is in the safety aspects of ensuring the pacifier is sanitary and clean.

Another feature demanded by the market is that any pacifier system be simple and easy to use. The pacifier should also have a small part count and eliminate areas that are difficult to maintain in a clean state.

Ever increasing market pressures also demand that pacifiers also be low cost. Lowering costs can be achieved by reducing part count, reducing the number of manufacturing steps, and reducing the number of materials used in manufacturing.

Many previous developments have been set forth in an attempt to provide a solution; however, prior developments have provided only partial solutions and there remains a considerable need for a pacifier system that can provide a sanitary, simple, and cost-effective solution.

One previous development, for example set forth in U.S. Pat. No. 9,198,836, entitled PACIFIER WITH RETRACTABLE NIPPLE, provides a retractable nipple for protecting the nipple in an attempt to maintain cleanliness. However, the nipple is attached to a shaft with a threaded portion, and requires an additional cup area for the shaft to slide into and out of. The threaded portion and the interior of the cup area can be highly difficult to clean. The threaded portion must be disassembled for cleaning while the cup area would likely require a soaking followed by cleaning with a special tool capable of reaching inside the cup area.

Furthermore, the threaded portion, the nipple, the shaft, and the cup area represent a high part count which would increase manufacturing complexity, increasing the number of manufacturing steps, and ultimately increasing costs of production. Yet further, the sliding action of the nipple and the shaft within the cup housing could potentially wear the shaft and nipple creating micro plastics that might be ingested by a child.

Another previous development, for example set forth in US PGPub No. 2018/0235846, entitled COMPRESSIBLE PACIFIER, provides a nipple attached to a compressible neck. This previous solution does provide a reduced part count and simplicity by utilizing a one-piece nipple and compressible neck. However, the compressible neck must be compressed by pushing on the outer surface of the nipple, which increases the risk that the nipple is contaminated and makes the retractable feature difficult to use for sanitary purposes.

Solutions have been long sought but prior developments have not taught or suggested any complete solutions, and solutions to these problems have long eluded those skilled in the art. Thus, there remains a considerable need for a pacifier system that can provide a sanitary, simple, and cost-effective solution.

SUMMARY

A pacifier system and methods, providing a sanitary, simple, and cost-effective solution, are disclosed. The pacifier system and methods can include: a shield; a shaft coupled to the shield; a nipple coupled to the shaft; and a membrane coupled between the shield and the shaft, the membrane providing a retracted configuration creating a storage cavity for the nipple based on the shaft being pulled away from the shield, and the membrane providing an extended configuration with the nipple exposed and extended past the shield based on the shaft being pressed toward the shield and the membrane inverting from the retracted configuration.

Other contemplated embodiments can include objects, features, aspects, and advantages in addition to or in place of those mentioned above. These objects, features, aspects, and advantages of the embodiments will become more apparent from the following detailed description, along with the accompanying drawings.

BRIEF DESCRIPTION OF THE DRAWINGS

The pacifier system is illustrated in the figures of the accompanying drawings which are meant to be exemplary and not limiting, in which like reference numerals are intended to refer to like components, and in which.

DETAILED DESCRIPTION

Figure 1:
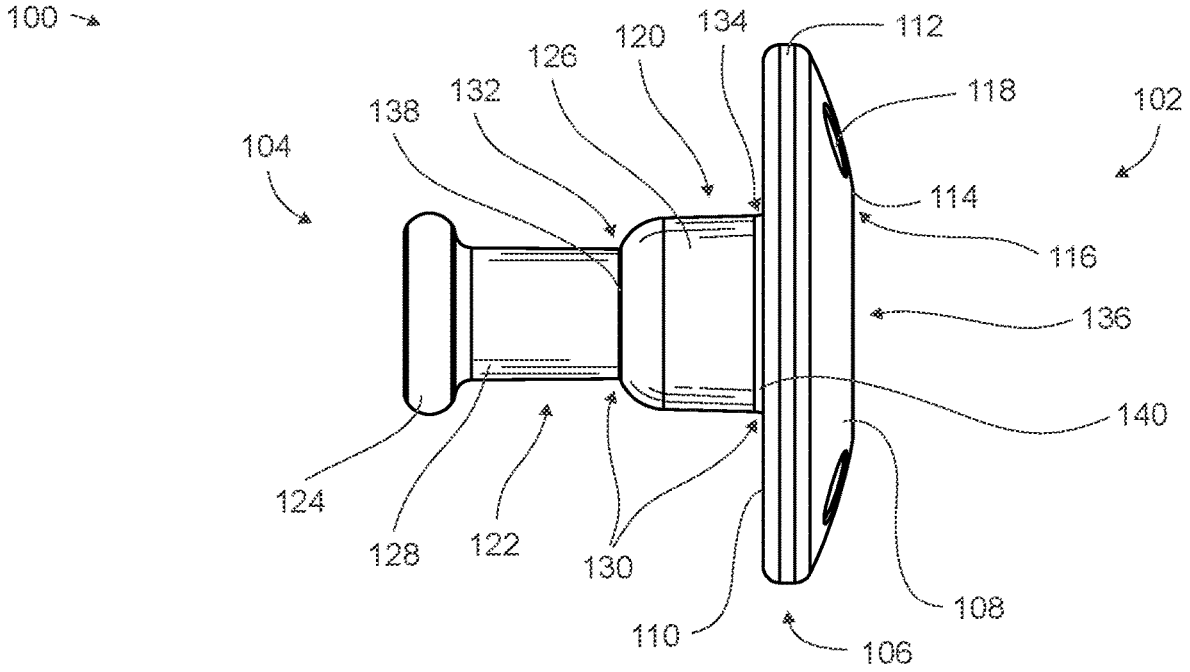
FIG. 1 is a top view of the pacifier system in a first embodiment and in a retracted configuration.

In the following description, reference is made to the accompanying drawings that form a part hereof, and in which are shown by way of illustration, embodiments in which the pacifier system may be practiced. It is to be understood that other embodiments may be utilized and structural changes may be made without departing from the scope of the pacifier system.

When features, aspects, or embodiments of the pacifier system are described in terms of steps of a process, an operation, a control flow, or a flow chart, it is to be understood that the steps can be combined, performed in a different order, deleted, or include additional steps without departing from the pacifier system as described herein.

The pacifier system is described in sufficient detail to enable those skilled in the art to make and use the pacifier system and provide numerous specific details to give a thorough understanding of the pacifier system; however, it will be apparent that the pacifier system may be practiced without these specific details.

In order to avoid obscuring the pacifier system, some well-known system configurations and descriptions are not disclosed in detail. Likewise, the drawings showing embodiments of the system are semi-diagrammatic and not to scale and, particularly, some of the dimensions are for the clarity of presentation and are shown greatly exaggerated in the drawing FIGs. As used herein, the term "coupled" is defined as physical connection between elements.

Referring now to FIG. 1, therein is shown a top view of the pacifier system 100 in a first embodiment and in a retracted configuration. The pacifier system 100 is depicted having a front 102 and a back 104.

The front 102 can be the portion of the pacifier system 100 facing a user while being used orally. The back 104 can be the portion of the pacifier system 100 facing away from the user while being used orally.

The pacifier system 100 can include a shield 106. The shield 106 can include both a shield front surface 108 and a shield back surface 110. The shield 106 can generally divide the pacifier system 100 between the front 102 and the back 104.

The shield back surface 110 and the shield front surface 108 can both transition into a shield peripheral surface 112. The shield front surface 108 can transition from a slightly convex shape to a rounded edge 114 between the shield front surface 108 and a shield interior surface 116. The shield interior surface 116 and the rounded edge 114 are described in greater detail with regard to FIGS. 11 and 12 below.

The shield 106 is further shown having air holes 118 extending through the shield 106 from the shield front surface 108 to the shield back surface 110. The shield 106 can prevent a user from lodging the pacifier system 100 within an airway and the air holes 118 can enable a user to breath from the mouth while the pacifier system 100 is being used orally.

In the retracted configuration, the back 104 is shown to include a membrane 120 coupled to the shield back surface 110 on one end and coupled to a shaft 122. The pacifier system 100 can transition from the shaft 122, which is depicted cylindrical in shape, to a protrusion handle 124.

The protrusion handle 124 has been advantageously discovered to decrease part count over other prior developments which included the use of handles, for example. The protrusion handle 124 can extend laterally away from the shaft 122 increasing in diameter and providing a comfortable gripping surface.

The membrane 120, more particularly, is depicted having a membrane back surface 126 extending from the shield back surface 110 to the shaft 122 leaving a shaft back portion 128 exposed between the membrane 120 and the protrusion handle 124.

The membrane 120 can be coupled to the shaft 122 and the shield 106 with hinge points 130 including a shaft hinge point 132 and a shield hinge point 134. The shaft hinge point 132 can contact the entire perimeter of the shaft 122, and likewise, the shield hinge point 134 can contact the shield 106 in an unbroken connection around the full perimeter of the membrane 120.

Figure 2:
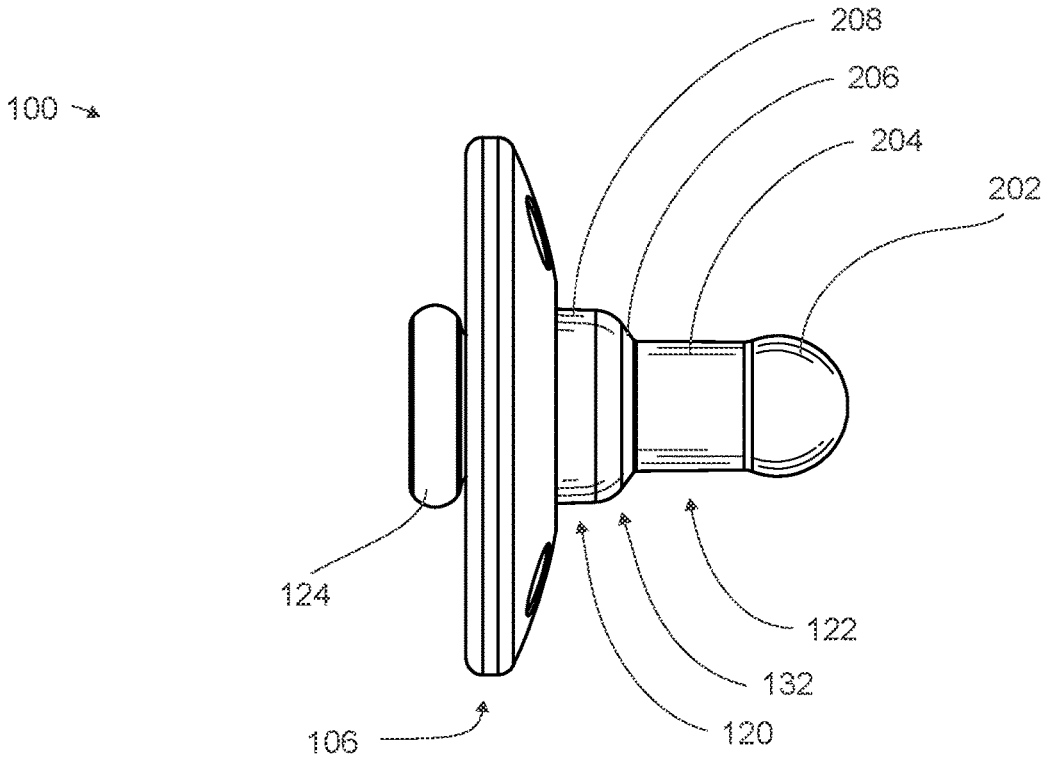
FIG. 2 is a top view of the pacifier system of FIG. 1 in an extended configuration.

Coupling the shaft 122 to the shield 106 with the membrane 120 without holes therein provides a storage cavity 136 for sanitary storage and protection of other elements of the pacifier system 100 such as the nipple 202 of FIG. 2 and the shaft 122. The membrane 120 extending unbroken from the shield 106 to the shaft 122 can increase isolation of the storage cavity 136 from the environment by forming an environmental barrier with the membrane back surface 126.

As is depicted in the retracted configuration, a shaft hinge point back surface 138 is an exposed surface of the shaft hinge point 132 while a shield hinge point back surface 140 is an exposed surface of the shield hinge point 134. When the pacifier system 100 is converted from the retracted to the extended configuration, the membrane 120 will invert as the shaft 122 is moved toward the front 102.

The conversion from the retracted configuration to the extended configuration can be accomplished as a step rather than a smooth slide. That is the shaft 122 can be pressed until it reaches a resistance threshold, after which, the shaft 122 will move forward with little effort at all. It has been discovered that providing the membrane 120 with the step style movement improves on prior developments that included a sliding action by allowing the pacifier system 100 to either be in the retracted configuration or in the extended configuration but not in a slidable position therebetween.

It is to be understood that the shaft 122 being pulled away from the shield or the shaft being pressed toward the shield can be accomplished with or without the use of the protrusion handle 124. That is, embodiments without the protrusion handle 124, with other types of handles, or no handle at all are contemplated and would not deviate from the pacifier system 100 described herein.

Providing a step style movement improves cleanliness by reducing the likelihood that the shaft 122 will partially move when unintended. Furthermore, the pacifier system 100 will tend not to convert to the extended configuration when the pacifier system 100 is dropped for example, but can easily do so when the protrusion handle 124 is intentionally pushed and the resistance threshold is overcome.

Yet furthermore, the membrane 120 has been discovered to reduce part count by providing a travel stop for the shaft 122 when it is pulled into the retracted configuration. That is, the membrane 120 can have a more or less fixed size, and when the protrusion handle 124 is pulled, the shaft 122 will travel backward until the membrane 120 is fully inverted with the membrane back surface 126 exposed.

When fully inverted, the membrane 120 will no longer allow the shaft 122 to travel towards the back 104. This improvement unexpectedly reduces the part count of previous developments which relied on stopper members or similar structures to prevent rearward travel of the shaft 122.

For the purposes of this application, the term "invert" or "inverted" means that the surfaces of the membrane are put in opposite positions. That is, when the membrane 120 is in the retracted configuration having the membrane front surface 208 of FIG. 2 facing the shaft 122 and the membrane back surface 126 facing away from the shaft 122, an inverted membrane 120 would have the membrane back surface 126 facing the shaft 122 and the membrane front surface 208 facing away from the shaft 122 to provide the extended configuration. Conversely, when the membrane 120 is in the extended configuration having the membrane front surface 208 facing away from the shaft 122 and the membrane back surface 126 facing toward the shaft 122, an inverted membrane 120 would have the membrane back surface 126 facing away from the shaft 122 and the membrane front surface 208 facing toward the shaft 122 providing the retracted configuration.

Referring now to FIG. 2, therein is shown a top view of the pacifier system 100 of FIG. 1 in an extended configuration. The pacifier system 100 is depicted having the protrusion handle 124 pressed in toward the shield 106 inverting the membrane 120 and forcing the shaft 122 out of the storage cavity 136 of FIG. 1.

The shaft 122 can be seen coupled to a nipple 202. The nipple 202 can extend laterally away from the shaft 122 and terminate in a rounded tip. However, other nipple shapes are contemplated and nipples having other shapes, sizes, or configurations do not deviate from the pacifier system 100 as described herein.

The nipple 202 is shown exposed and extended past the shield 106. The nipple 202 is directly connected to a shaft front portion 204. The shaft front portion 204 can be the portion of the shaft 122 between the shaft hinge point 132 and the nipple 202. The shaft hinge point 132 can divide the shaft 122 between the shaft back portion 128 of FIG. 1 and the shaft front portion 204.

The shaft hinge point 132 is shown with a shaft hinge point front surface 206 exposed while the shaft hinge point back surface 138 of FIG. 1 would be folded between the membrane 120 and the shaft back portion 128. Furthermore, the membrane 120 can have a membrane front surface 208 exposed and directly in contact with the shaft hinge point front surface 206.

It has been discovered that the membrane front surface 208 exposed while in the extended configuration and not exposed while in the retracted configuration provides many improvements over prior developments. One major improvement is that since the membrane front surface 208 is exposed it can be cleaned easily while in the extended configuration.

When placed in the retracted configuration, the membrane front surface 208 will invert and form the storage cavity 136 for the nipple 202, thus the storage cavity 136 can be easily cleaned unlike the interior of the cup area in prior developments, which can be highly difficult to clean.

Figure 3:
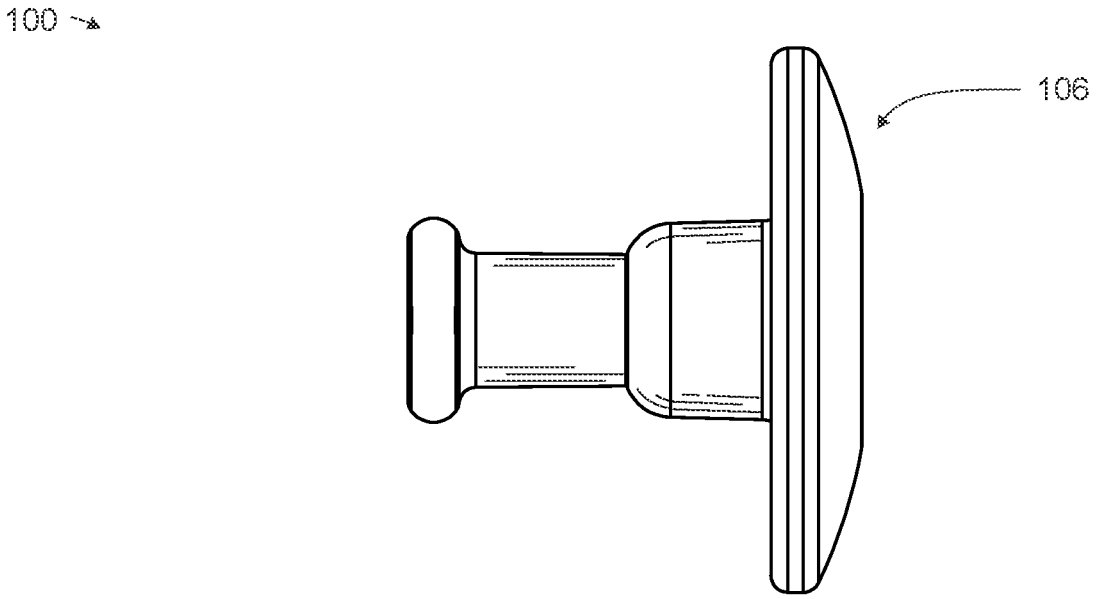
FIG. 3 is a bottom view of the pacifier system of FIG. 1 in the retracted configuration.

Referring now to FIG. 3, therein is shown a bottom view of the pacifier system 100 of FIG. 1 in the retracted configuration. The bottom view of the pacifier system 100 in the retracted configuration is shown to be similar to the pacifier system 100 as described in FIG. 1 above with the exception that the air holes 118 of FIG. 1 are not shown in the bottom area of the shield 106. It is contemplated that the air holes 118 could be repositioned within the shield 106 without departing from the description of the pacifier system 100 as provided herein.

Figure 4:
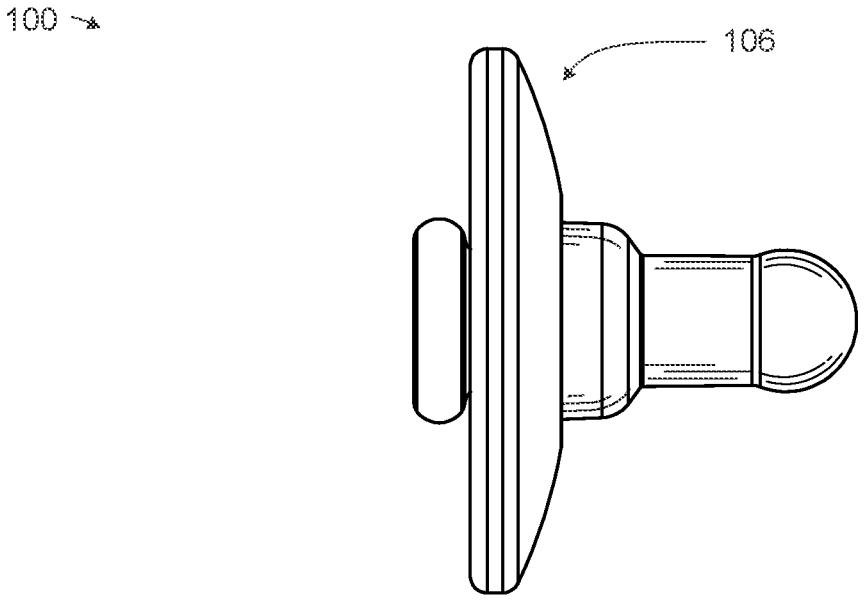
FIG. 4 is a bottom view of the pacifier system of FIG. 1 in the extended configuration.

Referring now to FIG. 4, therein is shown a bottom view of the pacifier system 100 of FIG. 1 in the extended configuration. The bottom view of the pacifier system 100 in the extended configuration is shown to be similar to the pacifier system 100 as described in FIG. 2 above with the exception that the air holes 118 of FIG. 1 are not shown in the bottom area of the shield 106. It is contemplated that the air holes 118 could be repositioned within the shield 106 without departing from the description of the pacifier system 100 as provided herein.

Figure 5:
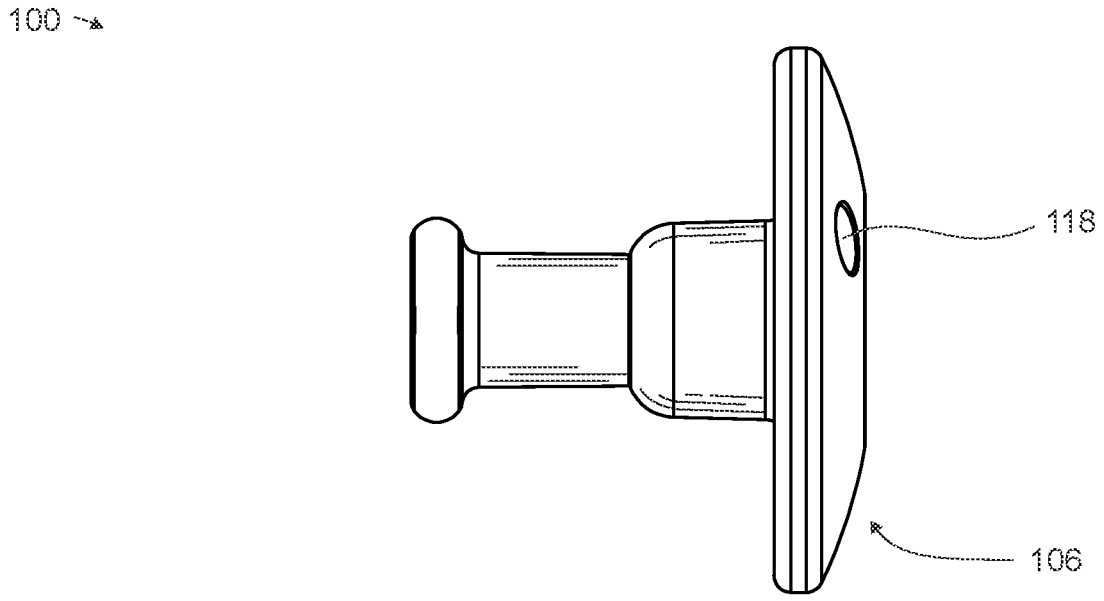
FIG. 5 is a side view of the pacifier system of FIG. 1 in the retracted configuration.

Referring now to FIG. 5, therein is shown a side view of the pacifier system 100 of FIG. 1 in the retracted configuration. The side view of the pacifier system 100 in the retracted configuration is shown to be similar to the pacifier system 100 as described in FIG. 1 above with the exception that only a single air hole 118 is shown extending through a side area of the shield 106.

Figure 6:
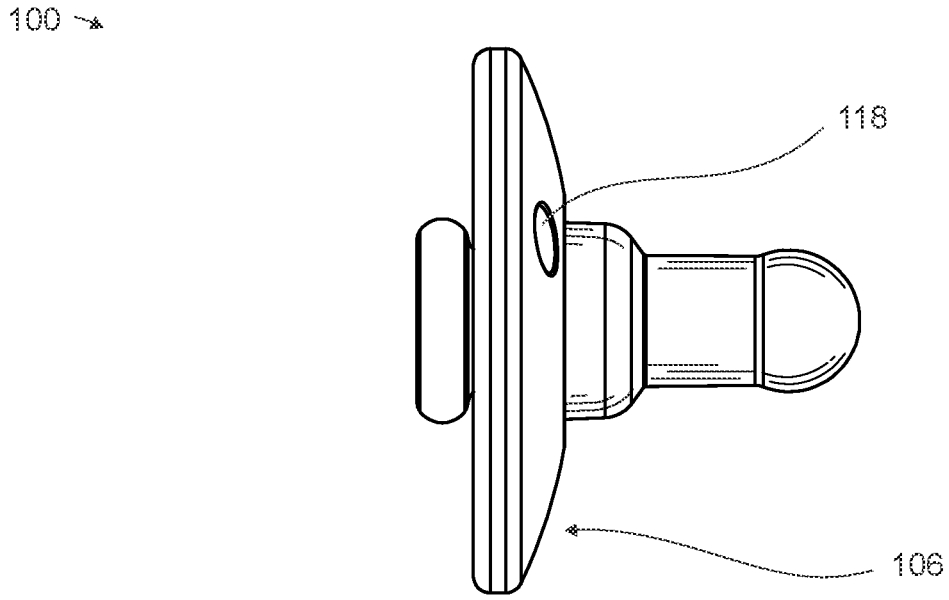
FIG. 6 is a side view of the pacifier system of FIG. 1 in the extended configuration.

Referring now to FIG. 6, therein is shown a side view of the pacifier system 100 of FIG. 1 in the extended configuration. The side view of the pacifier system 100 in the extended configuration is shown to be similar to the pacifier system 100 as described in FIG. 2 above with the exception that only a single air hole 118 is shown extending through a side area of the shield 106.

Figure 7:
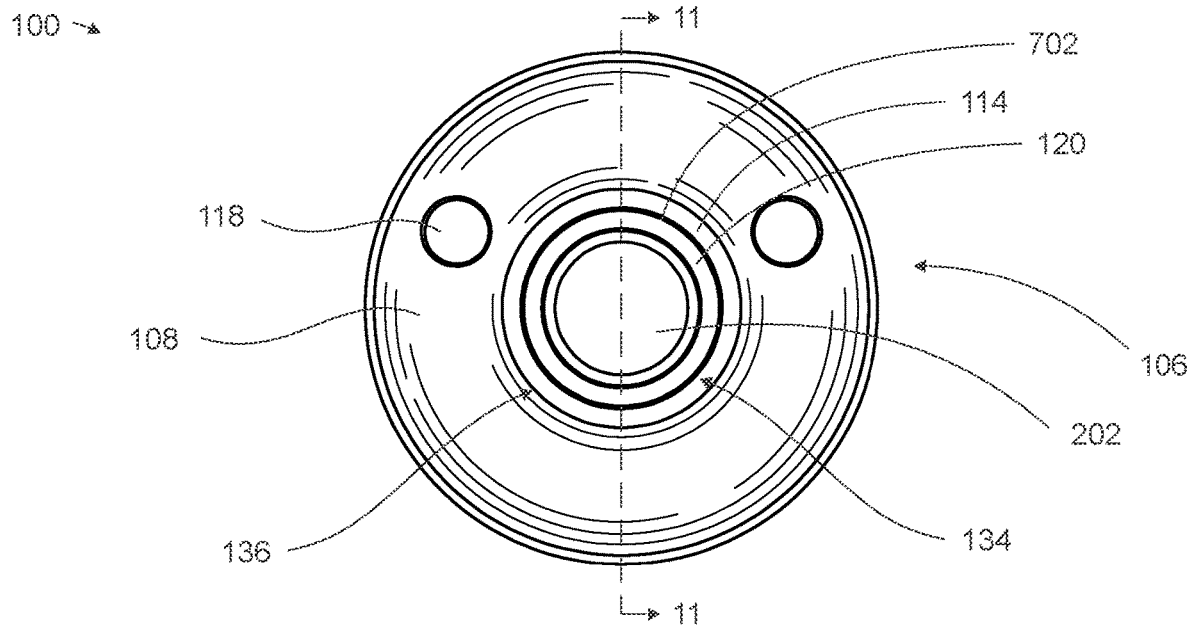
FIG. 7 is a front view of the pacifier system of FIG. 1 in the retracted configuration.

Referring now to FIG. 7, therein is shown a front view of the pacifier system 100 of FIG. 1 in the retracted configuration. The pacifier system 100 is shown with the nipple 202 surrounded laterally by the shield 106 and fully retracted within the storage cavity 136.

Between the shield 106 and the nipple 202, the membrane 120 can also be seen. The membrane 120 can be coupled to the shield 106 with the shield hinge point 134, and more particularly, a shield hinge point front surface 702 can be seen and can form one surface of the shield hinge point 134 together with the shield hinge point back surface 140 of FIG. 1.

The rounded edge 114 of the shield 106 is also visible from the front view. However, it is to be noted that the rounded edge 114 does not contact the shield hinge point 134 as will be shown and described in FIG. 11 below. The shield 106 is further depicted having the air holes 118 within the shield front surface 108.

Figure 8:
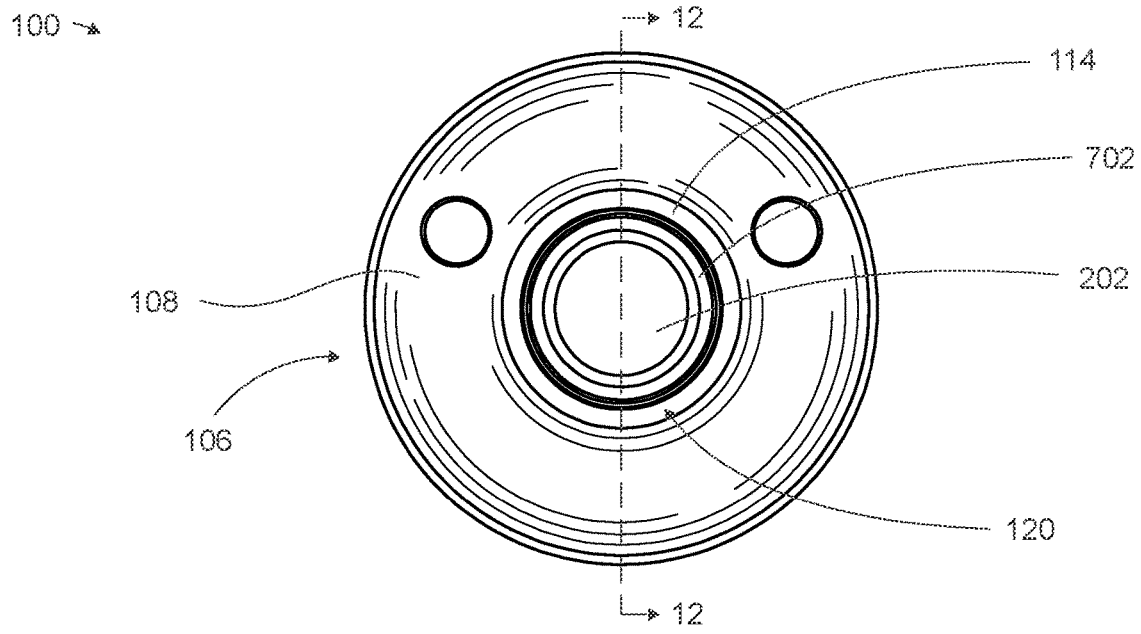
FIG. 8 is a front view of the pacifier system of FIG. 1 in the extended configuration.

Referring now to FIG. 8, therein is shown a front view of the pacifier system 100 of FIG. 1 in the extended configuration. The pacifier system 100 is shown with the nipple 202 extended out of the storage cavity 136 of FIG. 1 and immediately surrounded by the shield hinge point front surface 702 portion of the membrane 120.

The shield hinge point front surface 702 can be in direct contact with the shaft 122 of FIG. 1. The shield 106 is further depicted having the air holes 118 of FIG. 1 within the shield front surface 108.

Figure 9:
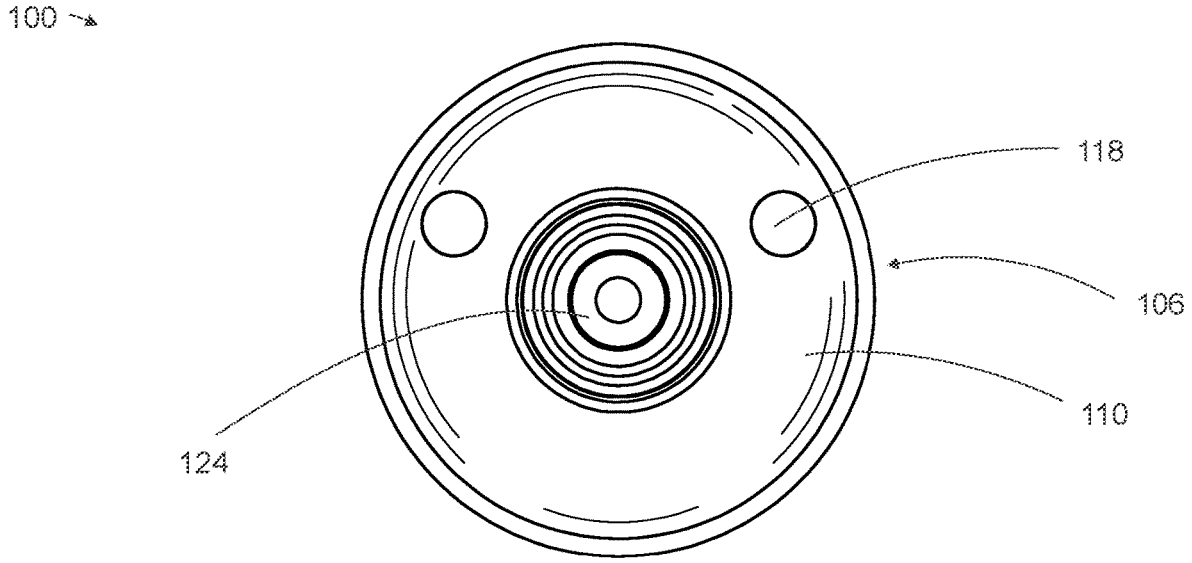
FIG. 9 is a back view of the pacifier system of FIG. 1 in the retracted configuration.

Referring now to FIG. 9, therein is shown a back view of the pacifier system 100 of FIG. 1 in the retracted configuration. The pacifier system 100 is depicted with the protrusion handle 124 surrounded by the shield 106 and with the air holes 118 extended through the shield back surface 110.

Figure 10:
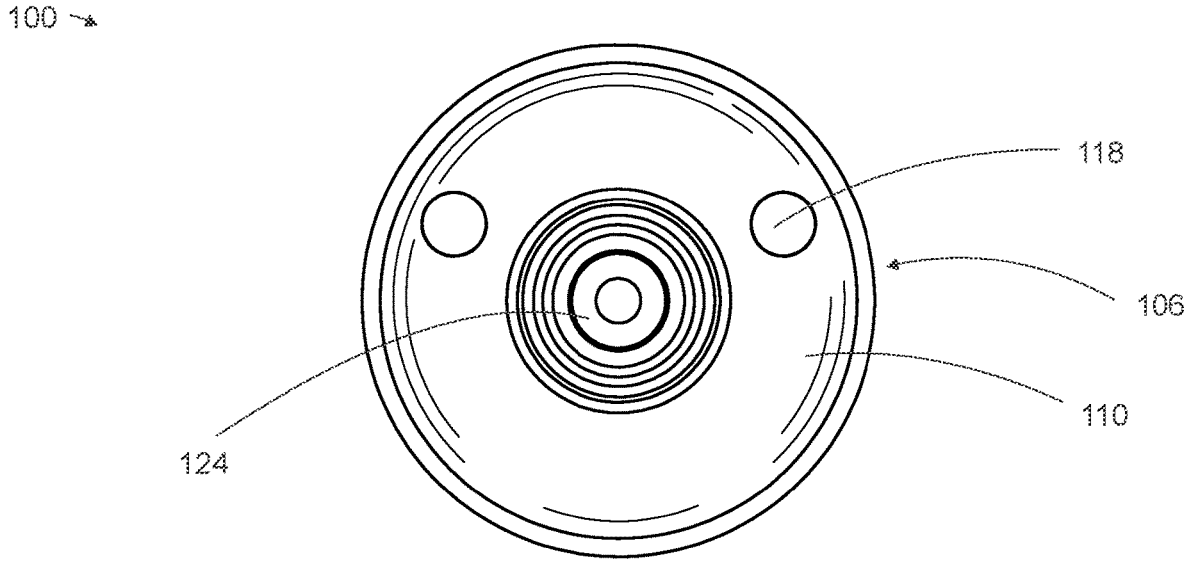
FIG. 10 is a back view of the pacifier system of FIG. 1 in the extended configuration.

Referring now to FIG. 10, therein is shown a back view of the pacifier system 100 of FIG. 1 in the extended configuration. The pacifier system 100 is depicted with the protrusion handle 124 surrounded by the shield 106 and with the air holes 118 extended through the shield back surface 110.

Figure 11:
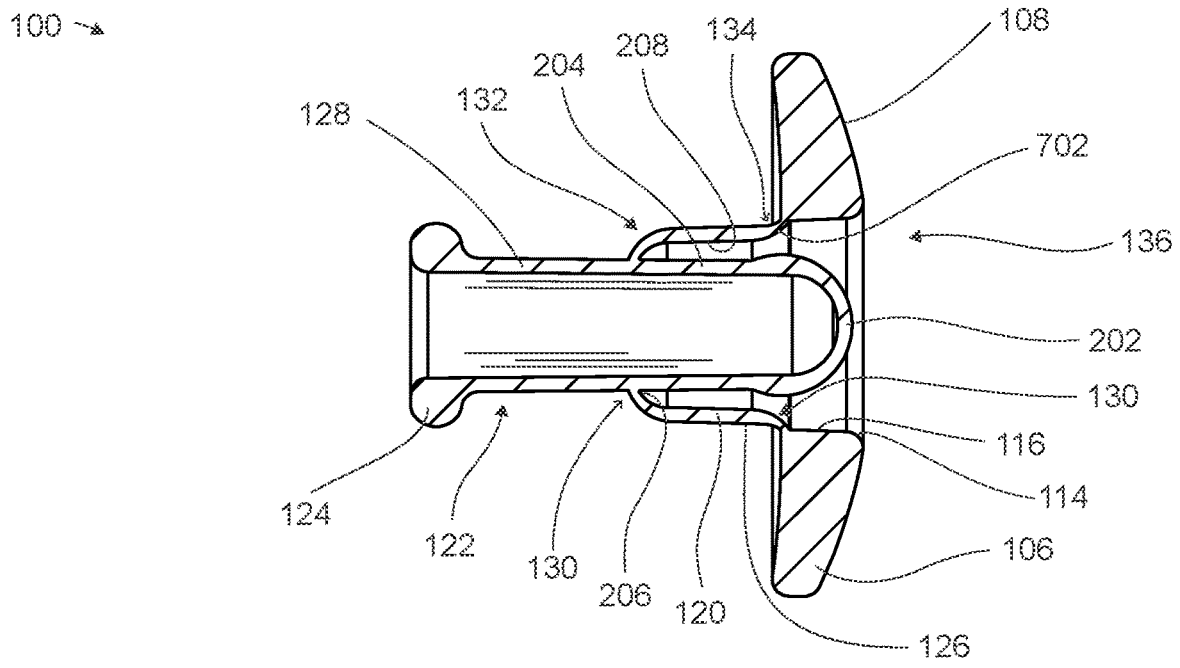
FIG. 11 is a cross-sectional view of the pacifier system along the line 11-11 of FIG. 7.

Referring now to FIG. 11, therein is shown a cross-sectional view of the pacifier system 100 along the line 11-11 of FIG. 7. The shield interior surface 116 and the membrane 120 are shown forming the storage cavity 136 for the nipple 202 therein. It is to be understood that the membrane 120 forms the storage cavity 136 for the nipple 202 with or without other elements such as the shaft 122 or the shield interior surface 116, and in some embodiments, the membrane 120 can be the sole element forming the storage cavity 136 for the nipple 202.

The storage cavity 136 can be comprised of the shield interior surface 116 and the membrane front surface 208. The membrane front surface 208 can further include the shield hinge point front surface 702 and the shaft hinge point front surface 206.

The storage cavity 136 can extend to house the shaft front portion 204 together with the nipple 202 when the pacifier system 100 is in the retracted configuration. The rounded edge 114 of the shield 106 can be extended further forward or further past the nipple 202 for protection.

The shield interior surface 116 can extend between the shield hinge point front surface 702 to the rounded edge 114. The rounded edge 114 can extend from the shield interior surface 116 to the shield front surface 108.

The storage cavity 136 can be wider near the shield interior surface 116 and narrower near the membrane front surface 208. It has been discovered that the wider storage cavity 136 near the shield interior surface 116 allows for the nipple 202 to be concealed without contacting the shield interior surface 116 or any portion of the storage cavity 136 while still allowing the shaft hinge point front surface 206 to be concealed within the narrower portion of the storage cavity 136. No contact between the storage cavity 136 and the nipple 202 or the shaft 122 is shown except for the contact between the shaft hinge point front surface 206 and the shaft front portion 204.

It has been discovered that utilizing the membrane 120 to form the storage cavity 136 has many unforeseen improvements because the membrane 120 can be used to precisely determine the distance the shaft 122 moves, no stopper member is needed to stop the nipple 202 from retracting too far. This further reduces unsanitary contact between elements and simultaneously reduces manufacturing complexity and part count. Furthermore, when the membrane 120 is combined with the shield interior surface 116 to form the storage cavity 136, a larger cavity with the shape of the nipple 202 mirrored in the shield interior surface 116 can be used.

The membrane 120 can be coupled to the shield interior surface 116 with the shield hinge point 134. The shaft 122 can be coupled to the membrane 120 with the shaft hinge point 132. The shaft hinge point 132 can separate the shaft front portion 204 from the shaft back portion 128.

The membrane 120 is shown with the membrane back surface 126 exposed and the membrane front surface 208 forming a large portion of the storage cavity 136. The membrane 120 is shown bisecting the shaft 122 at the shaft hinge point 132 between the protrusion handle 124 and the nipple 202 to create the shaft front portion 204 and the shaft back portion 128.

The membrane 120 can be inverted to provide the extended configuration by folding at the hinge points 130. The material thickness at the hinge points 130 is thinner with respect to the rest of the membrane 120 in order to create a hinge line where the material naturally wants to fold. As shown, the hinge points 130 can be about half of the cross-sectional thickness of the other portions of the membrane 120.

The shaft hinge point 132 is shown angled and extend over the shaft front portion 204 toward the shield 106. The shield hinge point 134 is shown angled and extended away from the shield interior surface 116 and extended toward the shaft 122.

The protrusion handle 124 is seen coupled to the shaft back portion 128. The shaft 122, the nipple 202, and the protrusion handle 124 are shown to be hollow which reduces material costs and makes the nipple 202 more pliable.

The pacifier system 100 can be formed as a single piece of material such as silicon, latex, rubber, or other appropriate material. Being formed as a single piece should be understood to mean that the pacifier system 100 can be formed without adhesive seams or mechanical coupling components such as threaded portions or pins.

One such method of forming as a single piece can be through injection molding during which all elements of the pacifier system 100 can be formed with one single piece of material. The pacifier system 100 can have characteristics of being formed by injection molding including seams created by an injection mold and surface irregularities created by injection ports.

Figure 12:
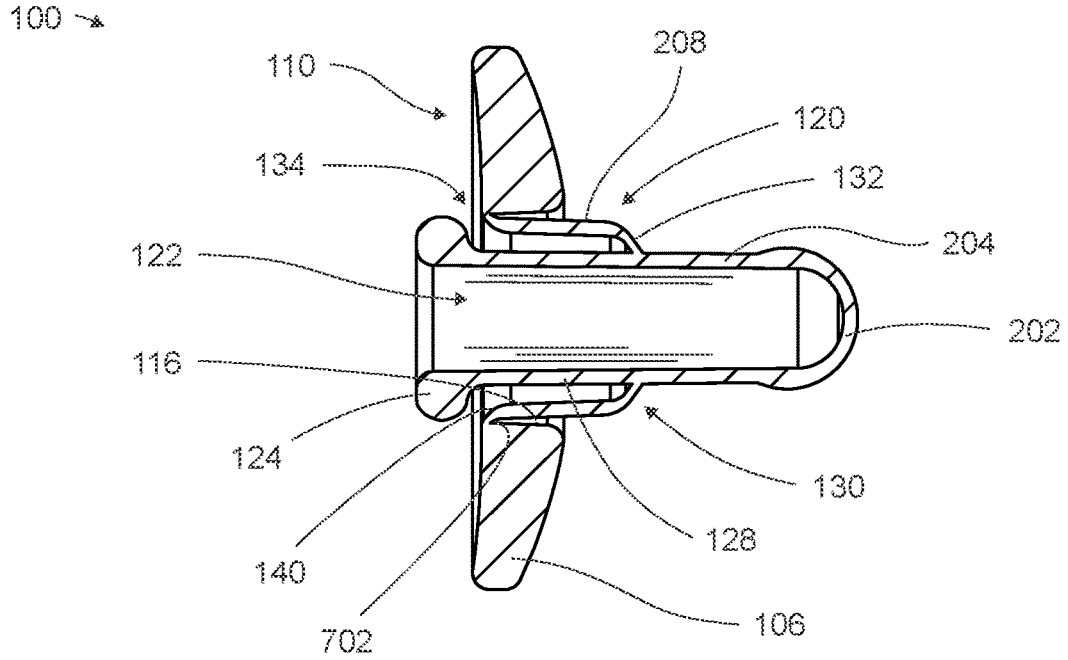
FIG. 12 is a cross-sectional view of the pacifier system along the line 12-12 of FIG. 8.

Referring now to FIG. 12, therein is shown a cross-sectional view of the pacifier system 100 along the line 12-12 of FIG. 8. The membrane 120 is shown inverted with the membrane front surface 208 exposed from between the shield interior surface 116. The hinge points 130 are also shown inverted with the shaft hinge point 132 angled and extended over the shaft back portion 128 toward the protrusion handle 124, while the shield hinge point 134 being angled and extended over the shaft back portion 128 and between the shield interior surface 116 toward the nipple 202.

The membrane 120 is shown to have no contact with the shield interior surface 116 except for the contact between the shield hinge point 134 and the shield interior surface 116. The membrane 120 can couple the shield 106 to the shaft 122.

The membrane 120 can be coupled to the shaft 122 with the shaft hinge point 132 between the shaft front portion 204 and the shaft back portion 128. The membrane 120 can be coupled to the shield 106 with the shield hinge point 134 coupled between the shield back surface 110 and the shield interior surface 116. More particularly, the shield hinge point 134 is shown with the shield hinge point front surface 702 in contact with the shield interior surface 116 while the shield hinge point back surface 140 is in contact with the shield back surface 110.

The protrusion handle 124 can be floating with respect to the shield 106 meaning that the protrusion handle 124 is not in contact with the shield 106 when in the extended configuration but is spaced apart therefrom. The membrane 120 has been discovered to provide a precise amount of motion and a robust physical placement of the protrusion handle 124 and the nipple 202 with respect to the shield 106.

That is, the nipple 202 and the protrusion handle 124 only move the length of the membrane 120 and no more, thus the stopper members of prior developments are not needed. Furthermore, since the membrane 120 fully circumscribes the shaft 122, the position of the shaft 122 with respect to the shield 106 is quite rigid allowing for precise placement of the shaft 122, in either the retracted or extended configurations, without the need for sliding elements, commonly found in prior developments, to maintain alignment between the shaft 122 and the shield 106.

Figure 13:
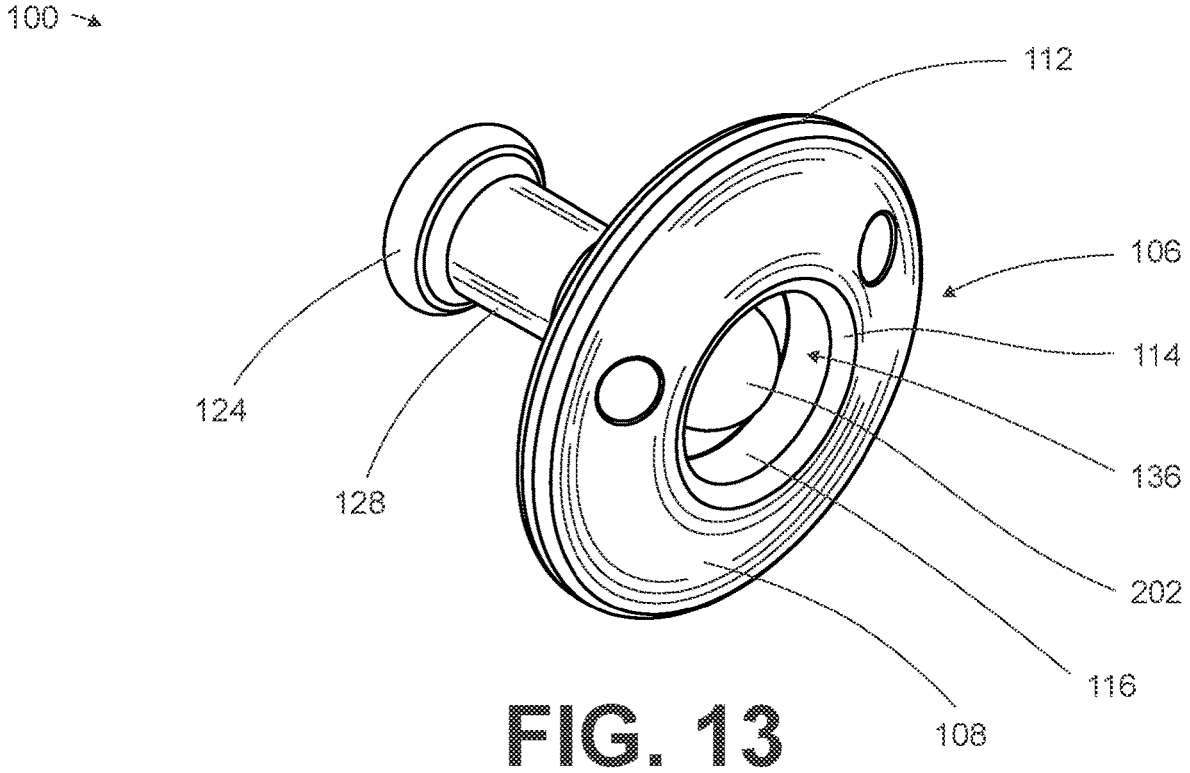
FIG. 13 is a front isometric view of the pacifier system of FIG. 1 in the retracted configuration.

Referring now to FIG. 13, therein is shown a front isometric view of the pacifier system 100 of FIG. 1 in the retracted configuration. The nipple 202 is shown fully retracted within the storage cavity 136 without contacting the shield interior surface 116.

The rounded edge 114 of the shield 106 can extend past the nipple 202 as is the shield front surface 108. The shield front surface 108 extends from the rounded edge 114 in a convex shape toward the shield peripheral surface 112. The protrusion handle 124 together with the shaft back portion 128 are fully pulled back away from the shield 106.

Figure 14:
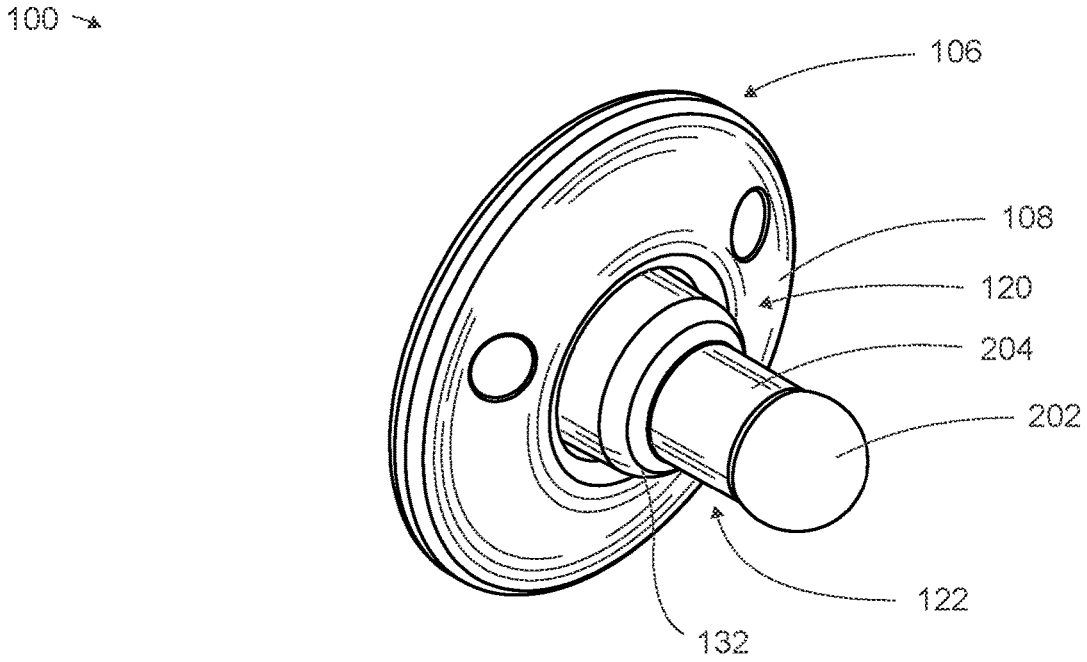
FIG. 14 is a front isometric view of the pacifier system of FIG. 1 in the extended configuration.

Referring now to FIG. 14, therein is shown a front isometric view of the pacifier system 100 of FIG. 1 in the extended configuration. The shaft front portion 204 and the nipple 202 are shown extended away from the shield front surface 108.

The shaft 122 is coupled to the shield 106 with the membrane 120 therebetween. Particularly, the membrane 120 is coupled to the shaft 122 with the shaft hinge point 132 while the membrane 120 is coupled to the shield 106 with the shield hinge point 134 of FIG. 1.

Figure 15:
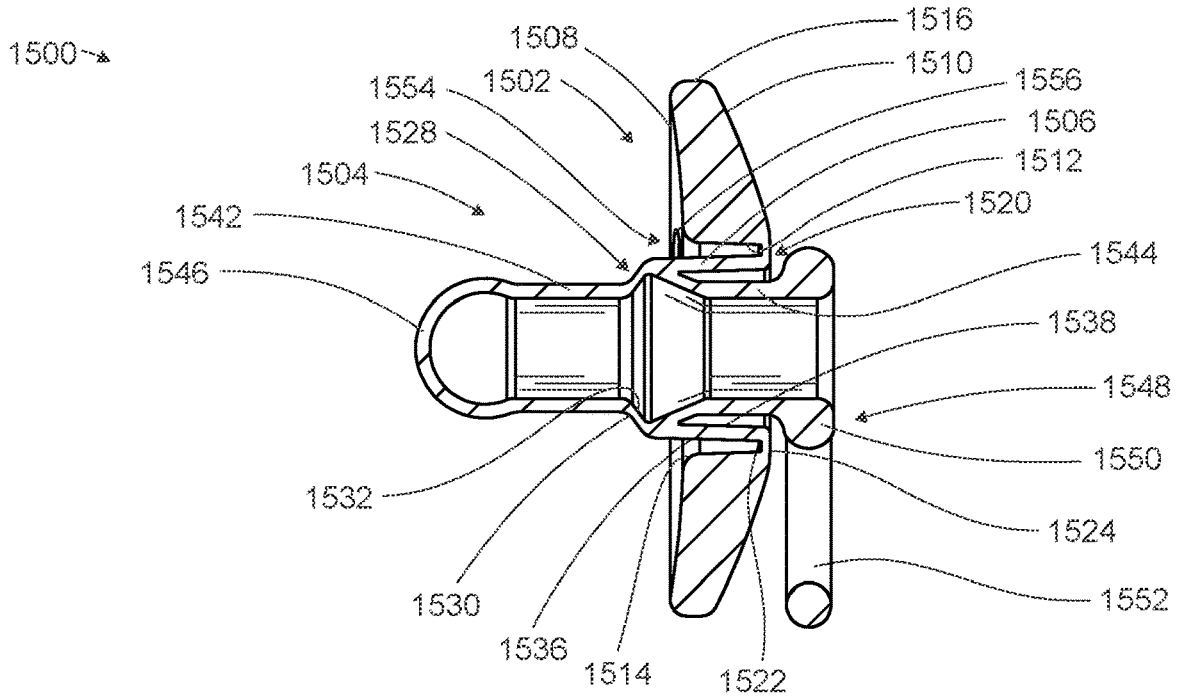
FIG. 15 is a cross-sectional view of the pacifier system in a second embodiment and in the extended configuration.

Referring now to FIG. 15, therein is shown a cross-sectional view of the pacifier system 1500 in a second embodiment and in the extended configuration. The pacifier system 1500 is shown having a shield 1502 coupled to a shaft 1504 with a membrane 1506.

The shield 1502 can include a shield front surface 1508 and a shield back surface 1510 opposite the shield front surface 1508. The shield front surface 1508 can be the portion of the pacifier system 1500 facing a user while being use orally.

The shield back surface 1510 can be the portion of the pacifier system 1500 facing away from the user while being used orally. The shield 1502 can generally divide the pacifier system 1500 between a front and a back.

The shield back surface 1510 and the shield front surface 1508 can both transition into a shield interior surface 1512. Between the shield interior surface 1512 and the shield front surface 1508, the shield 1502 can include a shield rounded edge 1514 for smoothly transitioning from the shield front surface 1508 to the shield interior surface 1512 and thereby prevent unnecessary ware on components of the shaft 1504 and provide additional comfort to the user.

The shield front surface 1508 and the shield back surface 1510 can further transition into a shield peripheral surface 1516. The shield peripheral surface 1516 is shown being rounded between the shield front surface 1508 and between the shield back surface 1510.

The shield 1502 and the shaft 1504 can be coupled to the membrane 1506 with hinge points. More particularly, the shield 1502 can be coupled to the membrane 1506 with a shield hinge point 1520.

The shield hinge point 1520 can include a shield hinge point front surface 1522 facing the same general direction as the shield front surface 1508. The shield hinge point 1520 can further include a shield hinge point back surface 1524 generally facing the same direction as the shield back surface 1510.

Furthermore, the membrane 1506 can be coupled to the shaft 1504 with a shaft hinge point 1528. The shaft hinge point 1528 is shown having a shaft hinge point front surface 1530 generally facing the same direction as the shield front surface 1508. The shaft hinge point 1528 can also include a shaft hinge point back surface 1532 generally facing the same direction as the shield back surface 1510.

Between the shaft hinge point front surface 1530 and the shield hinge point front surface 1522, the membrane 1506 can include a membrane front surface 1536 exposed to the front of the pacifier system 1500. Likewise, between the shaft hinge point back surface 1532 and the shield hinge point back surface 1524, the membrane 1506 can include a membrane back surface 1538 exposed to the back of the pacifier system 1500.

The coupling of the membrane 1506 to the shaft 1504 by way of the shaft hinge point 1528 can bifurcate the shaft 1504 into a shaft front portion 1542 and a shaft back portion 1544. The shaft front portion 1542 can extend from the shaft hinge point 1528 up to and include a nipple 1546.

The shaft back portion 1544 can extend from the shaft hinge point 1528 up to and include a handle 1548. The shaft back portion 1544 is shown to have a reduced cross-sectional thickness of the material forming the shaft 1504 near the membrane 1506 even while the shaft 1504 has a larger diameter. The shaft 1504 can be hollow for increased comfort, pliability, and reduced material during manufacturing, which helps to reduce costs. The handle 1548 is also shown as open-ended allowing the inside of the shaft 1504 to be accessible from the handle 1548.

The handle 1548 can be a protrusion handle with a protrusion 1550 extending away from and around the shaft 1504. Furthermore, the handle 1548 can include a ring 1552 directly attached to the protrusion 1550. It is contemplated that the handle 1548 can be formed of the protrusion 1550, the ring 1552, or a combination of both.

The ring 1552 can be formed as a single piece with the protrusion 1550, in which case the ring 1552 would bend when moved from its resting position. Other contemplated embodiments can include a hinged ring which would pivot when moved from its resting position.

The handle 1548 can be pressed forward toward the shield 1502 placing the pacifier system 1500 in the extended configuration or pulled back away from the shield 1502 placing the pacifier system 1500 in the retracted configuration. As is depicted in the extended configuration, the shaft hinge point front surface 1530 together with the membrane front surface 1536 is extended forward past the shield front surface 1508.

When the pacifier system 1500 is converted from the extended configuration to the retracted configuration, the membrane 1506 will invert as the shaft 1504 is moved toward the back. The conversion from the extended configuration to the retracted configuration can be accomplished as a step rather than a smooth slide.

That is the shaft 1504 can be pressed until it reaches a resistance threshold, after which, the shaft 1504 will move forward with little effort at all. It has been discovered that providing the membrane 1506 with the step style movement improves on prior developments that included a sliding action by allowing the pacifier system 1500 to either be in the retracted configuration or in the extended configuration but not in a slidable position therebetween.

Providing a step style movement improves cleanliness by reducing the likelihood that the shaft 1504 will partially move when unintended. Furthermore, the pacifier system 1500 will tend not to convert to the extended configuration when the pacifier system 1500 is dropped for example, but can easily do so when the handle 1548 is intentionally pushed and the resistance threshold is overcome.

Yet furthermore, the membrane 1506 has been discovered to reduce part count by providing a travel stop for the shaft 1504 when it is pushed into the extended configuration. That is, the membrane 1506 can have a more or less fixed size, and when the handle 1548 is pushed, the shaft 1504 will travel forward until the membrane 1506 is fully inverted with the membrane front surface 1536 exposed.

When fully inverted, the membrane 1506 will no longer allow the shaft 1504 to travel forward. This improvement unexpectedly reduces the part count of previous developments which relied on stopper members or similar structures to prevent forward or rearward travel of the shaft 1504.

The membrane 1506 can be inverted when the surfaces of the membrane are put in opposite positions. That is, when the membrane 1506 is in the retracted configuration having the membrane front surface 1536 facing the shaft 1504 and the membrane back surface 1538 facing away from the shaft 1504, an inverted membrane 1506 would have the membrane back surface 1538 facing the shaft 1504 and the membrane front surface 1536 facing away from the shaft 1504 as is depicted in the extended configuration.

Figure 16:
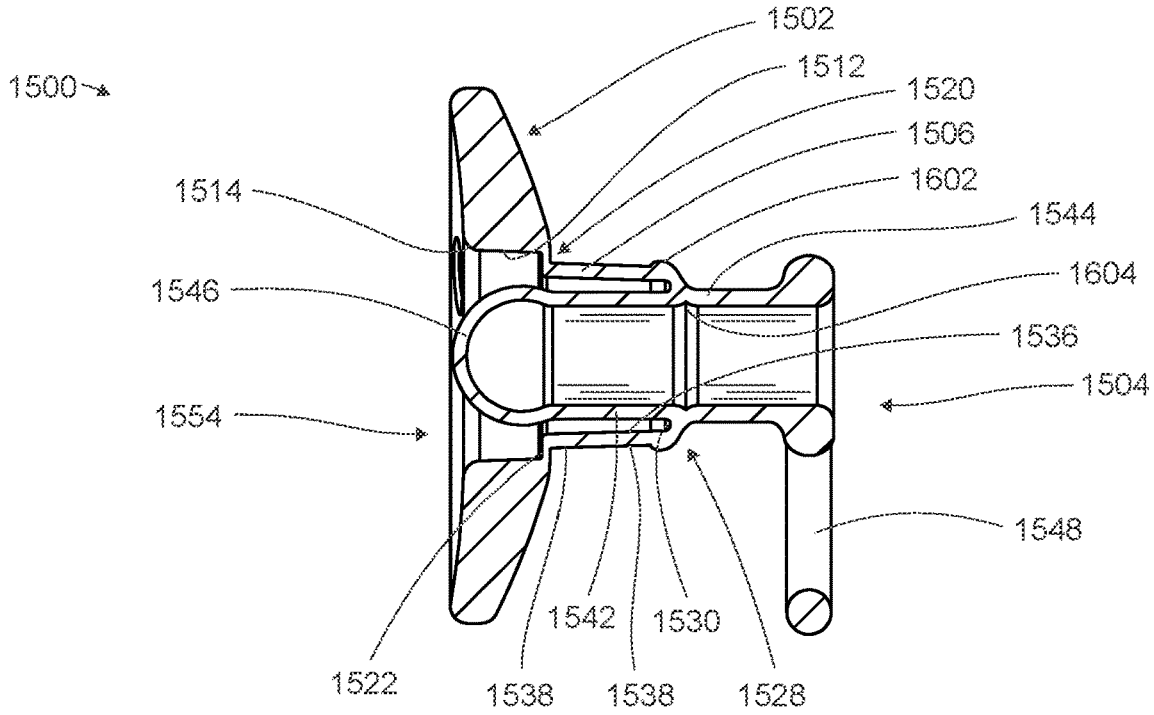
FIG. 16 is a cross-sectional view of the pacifier system of FIG. 15 in the retracted configuration.

Conversely, when the membrane 1506 is in the extended configuration having the membrane front surface 1536 facing away from the shaft 1504 and the membrane back surface 1538 facing toward the shaft 1504, an inverted membrane 1506 would have the membrane back surface 1538 facing away from the shaft 1504 and the membrane front surface 1536 facing toward the shaft 1504 as is depicted in the retracted configuration of FIG. 16, for example.

Pulling the handle 1548 backward can retract the shaft front portion 1542 including the nipple 1546 into a storage cavity 1554. The storage cavity 1554 can be comprised of the shield interior surface 1512 and the membrane front surface 1536.

As shown, in the extended configuration, the nipple 1546 is exposed and extended past the shield 1502. Furthermore, the shaft hinge point 1528 can extend away from the shaft 1504 and toward the shield 1502 forming an angled step ending in the membrane front surface 1536. The step formed by the shaft hinge point 1528 can help to prevent debris and larger objects from entering the storage cavity 1554 increasing the sanitation of the pacifier system 1500.

The conversion between the extended configuration and the retracted configuration can be achieved by inverting the membrane 1506 which requires folding at the shield hinge point 1520 and the shaft hinge point 1528. The material thickness of the shield hinge point 1520 is thinner with respect to the rest of the membrane 1506 in order to create a hinge line where the material naturally wants to fold. As shown, the shield hinge point 1520 can be about half of the cross-sectional thickness of the other portions of the membrane 1506 between the membrane front surface 1536 and the membrane back surface 1538.

The shield hinge point 1520 is shown angled and extend orthogonally from the membrane 1506 to contact the shield back surface 1510. In the extended configuration, the membrane 1506 can be substantially parallel to the shield interior surface 1512 and allow the shaft front portion 1542 to be thinner allowing for a smaller storage cavity 1554, and a smaller nipple 1546. This can provide better operability for use by smaller mouths as well as saving on manufacturing costs by reducing material.

The shaft back portion 1544 can be coupled between the shaft hinge point 1528 and the membrane back surface 1538 allowing the shaft back portion 1544 to angle up toward the membrane 1506 and creating a bulge in the shaft 1504 when in the extended configuration. The shaft 1504 can decrease in cross-sectional thickness as it stretches to reach the membrane 1506 in the extended configuration.

The bulge in the shaft 1504 can be partially extended beyond the shield front surface 1508 while beginning near the shield rounded edge 1514. The pacifier system 1500 can be formed as a single piece of material such as silicon, latex, rubber, or other appropriate material. Being formed as a single piece should be understood to mean that the pacifier system 1500 can be formed without adhesive seams or mechanical coupling components such as threaded portions or pins.

One such method of forming as a single piece can be through injection molding during which all elements of the pacifier system 1500 can be formed with one single piece of material. The pacifier system 1500 can have characteristics of being formed by injection molding including seams created by an injection mold and surface irregularities created by injection ports.

The shield 1502 is further shown having air holes 1556 extending through the shield 1502 from the shield front surface 1508 to the shield back surface 1510. The shield 1502 can prevent a user from lodging the pacifier system 1500 within an airway and the air holes 1556 can enable a user to breath from the mouth while the pacifier system 1500 is being used orally.

Referring now to FIG. 16, therein is shown a cross-sectional view of the pacifier system 1500 of FIG. 15 in the retracted configuration. The storage cavity 1554 can extend to house the shaft front portion 1542 together with the nipple 1546 when the pacifier system 1500 is in the retracted configuration. The shield rounded edge 1514 can be extended further forward or further past the nipple 1546 for protection.

The shield interior surface 1512 can extend between the shield hinge point front surface 1522 to the shield rounded edge 1514. The storage cavity 1554 can be wider near the shield interior surface 1512 and narrower near the membrane front surface 1536. It has been discovered that the wider storage cavity 1554 near the shield interior surface 1512 allows for the nipple 1546 to be concealed without contacting the shield interior surface 1512 or any portion of the storage cavity 1554 while still allowing the shaft hinge point front surface 1530 to be concealed within the narrower portion of the storage cavity 1554. No contact between the storage cavity 1554 and the nipple 1546 or the shaft 1504 is shown except for the contact between the shaft hinge point front surface 1530 and the shaft front portion 1542.

It has been discovered that utilizing the membrane 1506 to form the storage cavity 1554 has many unforeseen improvements because the membrane 1506 can be used to precisely determine the distance the shaft 1504 travels, no stopper member is needed to stop the nipple 1546 from retracting too far. This further reduces unsanitary contact between elements and simultaneously reduces manufacturing complexity and part count. Furthermore, when the membrane 1506 is combined with the shield interior surface 1512 to form the storage cavity 1554, a larger cavity with the shape of the nipple 1546 mirrored in the shield interior surface 1512 can be used.

The membrane 1506 is shown with the membrane back surface 1538 exposed and the membrane front surface 1536 forming a large portion of the storage cavity 1554. The membrane 1506 is shown bisecting the shaft 1504 at the shaft hinge point 1528 between the handle 1548 and the nipple 1546 to create the shaft front portion 1542 and the shaft back portion 1544.

The membrane 1506 is shown having a protuberance 1602 for maintaining the membrane 1506 in a substantially parallel relationship with the shield interior surface 1512 when in the extended configuration. That is, the protuberance 1602 can push the membrane 1506 out and away from the shaft 1504 when in the extended configuration allowing for a smaller shaft 1504 and smaller nipple 1546, as previously noted. Because the shaft 1504 can be thinner and the nipple 1546 smaller, the storage cavity 1554 can also be smaller, which requires less material to manufacture and reduces costs.

Furthermore, the interior surface of the shaft 1504 is shown having an indentation 1604 at the point where the shaft hinge point 1528 contacts the shaft 1504. The indentation 1604 can enable the shaft 1504 to stretch and reduce cross-sectional thickness of the material forming the shaft 1504 near the membrane 1506 when in the extended configuration.

The membrane 1506 can be inverted to provide the extended configuration by folding at the hinge points. The material thickness at the hinge points is thinner with respect to the rest of the membrane 1506 in order to create a hinge line where the material naturally wants to fold.

The shaft hinge point 1528 is shown angled and extend over the shaft front portion 1542 toward the shield 1502. The shield hinge point 1520 is shown extended orthogonally away from the shield interior surface 1512 toward the shaft 1504 to create a right angled step within the storage cavity 1554.

It is contemplated that the shaft hinge point 1528 can contact the entire perimeter of the shaft 1504, and likewise, the shield hinge point 1520 can contact the shield 1502 in an unbroken connection around the full perimeter of the membrane 1506. Coupling the shaft 1504 to the shield 1502 with the membrane 1506 without holes therein provides the storage cavity 1554 for sanitary storage and protection of many elements of the pacifier system 1500 such as the nipple 1546 and the shaft 1504. The unbroken membrane 1506 extending around the shaft 1504 and the shield 1502 can help isolate the storage cavity 1554 from the environment by forming an environmental barrier with the membrane back surface 1538.

Figure 17:
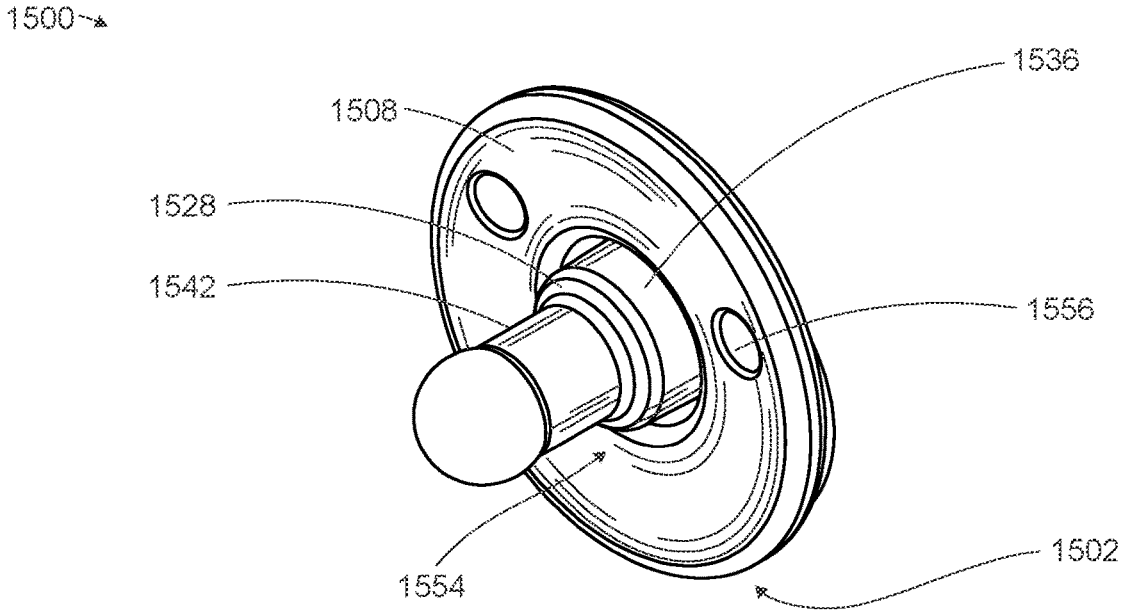
FIG. 17 is a front isometric view of the pacifier system of FIG. 15 in the extended configuration.

Referring now to FIG. 17, therein is shown a front isometric view of the pacifier system 1500 of FIG. 15 in the extended configuration. The pacifier system 1500 is shown having the membrane front surface 1536 extended from the storage cavity 1554 exposing the shaft front portion 1542 therefrom.

The shaft hinge point 1528 is shown between the membrane front surface 1536 and the shaft front portion 1542 forming a stepped transition. The stepped transition can be extended past the shield front surface 1508. The air holes 1556 are also clearly depicted within the shield 1502.

Figure 18:
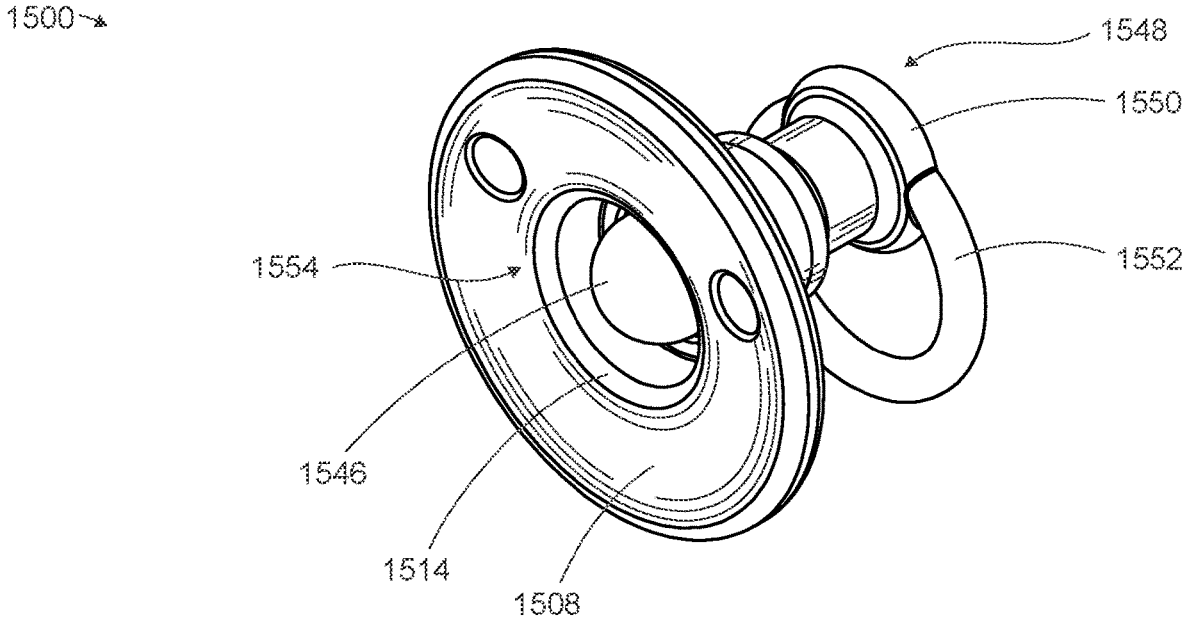
FIG. 18 is a front isometric view of the pacifier system of FIG. 15 in the retracted configuration.

Referring now to FIG. 18, therein is shown a front isometric view of the pacifier system 1500 of FIG. 15 in the retracted configuration. The nipple 1546 is shown fully retracted within the storage cavity 1554.

The shield rounded edge 1514 and shield front surface 1508 can be positioned further forward than the nipple 1546 for protection. The handle 1548 can be seen with the ring 1552 affixed to the protrusion 1550.

Figure 19:
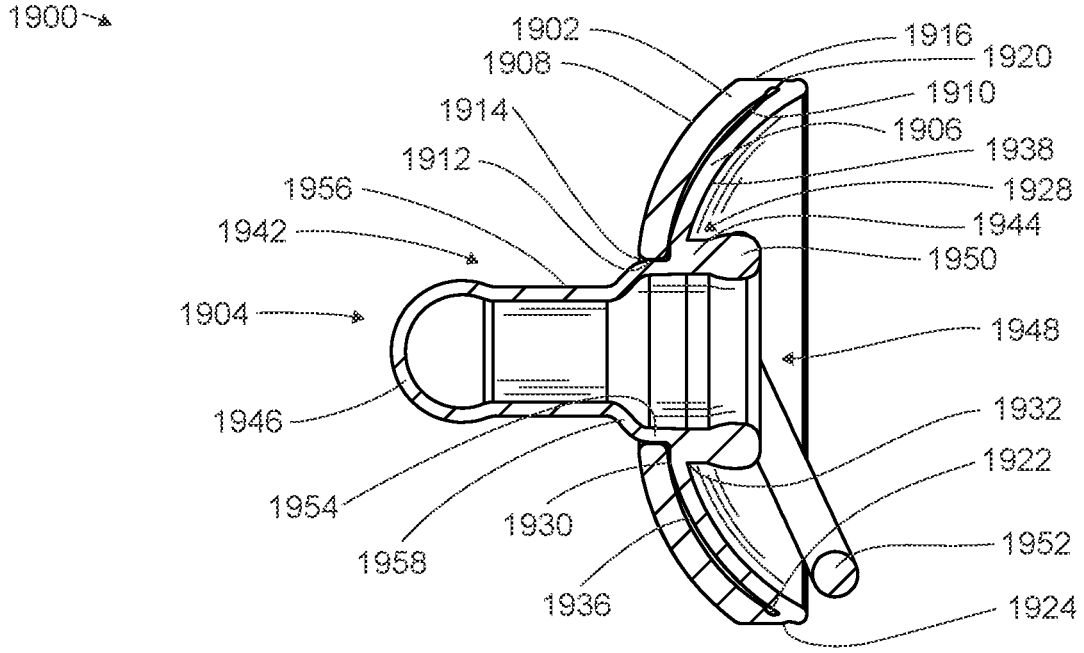
FIG. 19 is a cross-sectional view of the pacifier system in a third embodiment and in the extended configuration.

Referring now to FIG. 19, therein is shown a cross-sectional view of the pacifier system 1900 in a third embodiment and in the extended configuration. The pacifier system 1900 is shown having a shield 1902 coupled to a shaft 1904 with a membrane 1906.

The shield 1902 can include a shield front surface 1908 and a shield back surface 1910 opposite the shield front surface 1908. The shield front surface 1908 can be the portion of the pacifier system 1900 facing a user while being use orally.

The shield back surface 1910 can be the portion of the pacifier system 1900 facing away from the user while being used orally. The shield 1902 can generally divide the pacifier system 1900 between a front and a back.

The shield back surface 1910 and the shield front surface 1908 can both transition into a shield interior surface 1912. Between the shield interior surface 1912 and the shield front surface 1908, the shield 1902 can include a shield edge 1914 for transitioning from the shield front surface 1908 to the shield interior surface 1912 and thereby providing a very small gap between the shaft 1904 and the shield 1902.

The shield front surface 1908 can further transition into a shield peripheral surface 1916. The shield peripheral surface 1916 is shown being flat up to the shield front surface 1908.

The shield 1902 and the shaft 1904 can be coupled to the membrane 1906 with hinge points. More particularly, the shield 1902 can be coupled to the membrane 1906 with a shield hinge point 1920.

The shield hinge point 1920 can include a shield hinge point front surface 1922 facing the shaft 1904 and between the shield 1902 and the membrane 1906. The shield hinge point 1920 can further include a shield hinge point back surface 1924 generally facing the same direction as the shield peripheral surface 1916.

Furthermore, the membrane 1906 can be coupled to the shaft 1904 with a shaft hinge point 1928. The shaft hinge point 1928 is shown having a shaft hinge point front surface 1930 generally facing the same direction as the shield front surface 1908. The shaft hinge point 1928 can also include a shaft hinge point back surface 1932 generally facing the same direction as the shield back surface 1910.

Between the shaft hinge point front surface 1930 and the shield hinge point front surface 1922, the membrane 1906 can include a membrane front surface 1936 following the contour of the shield back surface 1910. Likewise, between the shaft hinge point back surface 1932 and the shield hinge point back surface 1924, the membrane 1906 can include a membrane back surface 1938 exposed to the back of the pacifier system 1900, and also following the contour of the shield back surface 1910.

The coupling of the membrane 1906 to the shaft 1904 by way of the shaft hinge point 1928 can bifurcate the shaft 1904 into a shaft front portion 1942 and a shaft back portion 1944. The shaft front portion 1942 can extend from the shaft hinge point 1928 up to and include a nipple 1946.

The shaft back portion 1944 can extend from the shaft hinge point 1928 up to and include a handle 1948. The shaft 1904 can be hollow for increased comfort, pliability, and reduced material during manufacturing, which helps to reduce costs. The handle 1948 is also shown as open-ended allowing the inside of the shaft 1904 to be accessible from the handle 1948.

The handle 1948 can be a protrusion handle with a protrusion 1950 extending away from and around the shaft 1904. Furthermore, the handle 1948 can include a ring 1952 directly attached to the protrusion 1950.

The ring 1952 can be formed as a single piece with the protrusion 1950, in which case the ring 1952 would bend when moved from its resting position. Other contemplated embodiments can include a hinged ring which would pivot when moved from its resting position.

The handle 1948 can be pressed forward toward the shield 1902 placing the pacifier system 1900 in the extended configuration or pulled back away from the shield 1902 placing the pacifier system 1900 in the retracted configuration. As is depicted in the extended configuration, the shaft hinge point front surface 1930 together with the membrane front surface 1936 is extended forward up to the shield back surface 1910.

When the pacifier system 1900 is converted from the extended configuration to the retracted configuration, the membrane 1906 will invert as the shaft 1904 is moved toward the back. The conversion from the extended configuration to the retracted configuration can be accomplished as a step rather than a smooth slide.

That is the shaft 1904 can be pressed until it reaches a resistance threshold, after which, the shaft 1904 will move forward with little effort at all. It has been discovered that providing the membrane 1906 with the step style movement improves on prior developments that included a sliding action by allowing the pacifier system 1900 to either be in the retracted configuration or in the extended configuration but not in a slidable position therebetween.

Providing a step style movement improves cleanliness by reducing the likelihood that the shaft 1904 will partially move when unintended. Furthermore, the pacifier system 1900 will tend not to convert to the extended configuration when the pacifier system 1900 is dropped for example, but can easily do so when the handle 1948 is intentionally pushed and the resistance threshold is overcome.

Yet furthermore, the membrane 1906 has been discovered to reduce part count by providing a travel stop for the shaft 1904 when it is pushed into the extended configuration. That is, the membrane 1906 directly contact the shield back surface 1910 and preventing further forward travel.

When fully inverted, the membrane 1906 will no longer allow the shaft 1904 to travel forward. This improvement unexpectedly reduces the part count of previous developments which relied on stopper members or similar structures to prevent forward or rearward travel of the shaft 1904.

The membrane 1906 can be inverted when the surfaces of the membrane are put in opposite positions. That is, when the membrane 1906 is in the retracted configuration having the membrane front surface 1936 mirroring the contour of the shield back surface 1910, an inverted membrane 1906 would have the membrane front surface 1936 following the contour of the shield back surface 1910 as is depicted in the extended configuration.

Figure 20:
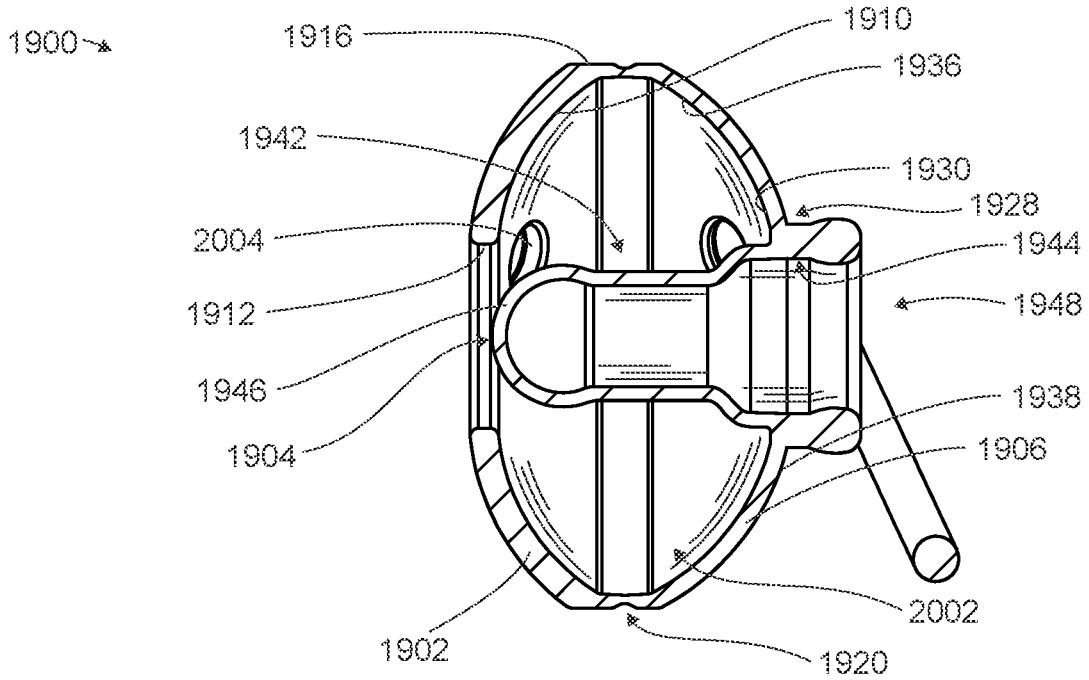
FIG. 20 is a cross-sectional view of the pacifier system of FIG. 19 in the retracted configuration.

Conversely, when the membrane 1906 is in the extended configuration having the membrane front surface 1936 following the contour of the shield back surface 1910, an inverted membrane 1906 would have the membrane front surface 1936 mirroring the shield back surface 1910 as is depicted in the retracted configuration of FIG. 20, for example.

Pulling the handle 1948 backward can retract the shaft front portion 1942 including the nipple 1946 into the storage cavity 2002 of FIG. 20. The storage cavity 2002 can be comprised of the shield interior surface 1912 and the membrane front surface 1936.

As shown, in the extended configuration, the shaft hinge point 1928 can extend away from the shaft 1904 and toward the shield peripheral surface 1516 forming a smooth transition between the shaft hinge point 1928 and the membrane 1906. The conversion between the extended configuration and the retracted configuration can be achieved by inverting the membrane 1906 which requires folding at the shield hinge point 1920 and the shaft hinge point 1928.

The material thickness of the shield hinge point 1920 is thinner with respect to the rest of the membrane 1906 in order to create a hinge line where the material naturally wants to fold. As shown, the shield hinge point 1920 can be about half of the cross-sectional thickness of the other portions of the membrane 1906 between the membrane front surface 1936 and the membrane back surface 1938. The shield hinge point 1920 is shown as a dimple between the membrane 1906 and the shield 1902.

The shaft back portion 1944 can be coupled to the shaft hinge point 1928 and the membrane back surface 1938. The shaft back portion 1944 can have a larger cross-sectional thickness than the shaft front portion 1942 as it extends from the shaft hinge point 1928 to the handle 1948.

The shaft front portion 1542 can include a thicker portion 1954 and a thinner portion 1956 with a sloping transition 1958 therebetween. The thicker portion 1954 can be in direct contact with the shield interior surface 1912. The sloping transition 1958 can extend from the shield edge 1914 and the thicker portion 1954 to the narrower portion 1956.

The pacifier system 1900 can be formed as a single piece of material such as silicon, latex, rubber, or other appropriate material. Being formed as a single piece should be understood to mean that the pacifier system 1900 can be formed without adhesive seams or mechanical coupling components such as threaded portions or pins.

One such method of forming as a single piece can be through injection molding during which all elements of the pacifier system 1900 can be formed with one single piece of material. The pacifier system 1900 can have characteristics of being formed by injection molding including seams created by an injection mold and surface irregularities created by injection ports.

Referring now to FIG. 20, therein is shown a cross-sectional view of the pacifier system 1900 of FIG. 19 in the retracted configuration. A storage cavity 2002 is shown formed between the shield back surface 1910 and the membrane front surface 1936.

The storage cavity 2002 can house the shaft front portion 1942 together with the nipple 1946 when the pacifier system 1900 is in the retracted configuration. The shield edge 1914 can be extended further forward or further past the nipple 1946 for protection.

The storage cavity 2002 can be formed between the membrane front surface 1936 and the shield back surface 1910. No contact between the storage cavity 2002 and the nipple 1946 or the shaft 1904 is shown except for the contact between the shaft hinge point front surface 1930 and the shaft front portion 1942.

It has been discovered that utilizing the membrane 1906 to form the storage cavity 2002 has many unforeseen improvements because the membrane 1906 can be used to precisely determine the distance the shaft 1904 travels, no stopper member is needed to stop the nipple 1946 from retracting too far. This further reduces unsanitary contact between elements and simultaneously reduces manufacturing complexity and part count. Furthermore, when the membrane 1906 is combined with the shield interior surface 1912 and the shield back surface 1910 to form the storage cavity 2002, a larger cavity can be used.

The membrane 1906 is shown with the membrane back surface 1938 exposed and the membrane front surface 1936 forming a large portion of the storage cavity 2002. The membrane 1906 is shown bisecting the shaft 1904 at the shaft hinge point 1928 between the handle 1948 and the nipple 1946 to create the shaft front portion 1942 and the shaft back portion 1944.

The membrane 1906 can be inverted to provide the extended configuration by folding at the hinge points. The material thickness at the shield hinge point 1920 is thinner with respect to the rest of the membrane 1906 in order to create a hinge line where the material naturally wants to fold. The shaft hinge point 1928, however is shown having the same thickness as the membrane 1906 due to the shaft hinge point 1928 not needing to fold as readily as is required for other embodiments described herein.

The shaft hinge point 1928 is shown angled and extend over the shaft front portion 1942 toward the shield 1902. The shield hinge point 1920 is shown extended away from the shield 1502 and in line with the shield peripheral surface 1916.

It is contemplated that the shaft hinge point 1928 can contact the entire perimeter of the shaft 1904, and likewise, the shield hinge point 1920 can contact the shield 1902 in an unbroken connection around the full perimeter of the membrane 1906. Unlike other embodiments described herein, the membrane 1906 can include air holes 2004 extended through both the membrane 1906 and the shield 1902. The air holes 1956 in the membrane 1906 and the shield 1902 can align when the pacifier system 1900 is in the extended configuration.

Figure 21:
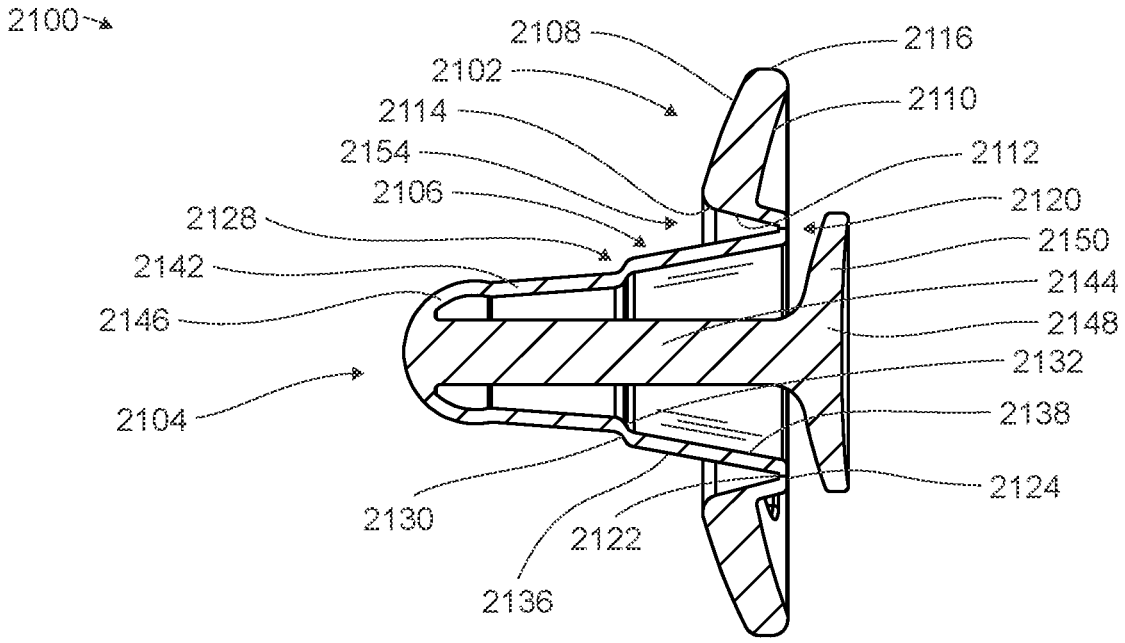
FIG. 21 is a cross-sectional view of the pacifier system in a fourth embodiment and in the extended configuration.

Referring now to FIG. 21, therein is shown a cross-sectional view of the pacifier system 2100 in a fourth embodiment and in the extended configuration. The pacifier system 2100 is shown having a shield 2102 coupled to a shaft 2104 with a membrane 2106.

The shield 2102 can include a shield front surface 2108 and a shield back surface 2110 opposite the shield front surface 2108. The shield front surface 2108 can be the portion of the pacifier system 2100 facing a user while being use orally.

The shield back surface 2110 can be the portion of the pacifier system 2100 facing away from the user while being used orally. The shield 2102 can generally divide the pacifier system 2100 between a front and a back.

The shield back surface 2110 and the shield front surface 2108 can both transition into a shield interior surface 2112. Between the shield interior surface 2112 and the shield front surface 2108, the shield 2102 can include a shield rounded edge 2114 for smoothly transitioning from the shield front surface 2108 to the shield interior surface 2112 and thereby prevent unnecessary ware on components of the shaft 2104 and provide greater comfort to the user.

The shield front surface 2108 and the shield back surface 2110 can further transition into a shield peripheral surface 2116. The shield peripheral surface 2116 is shown being rounded between the shield front surface 2108 and between the shield back surface 2110.

The shield 2102 and the shaft 2104 can be coupled to the membrane 2106 with hinge points. More particularly, the shield 2102 can be coupled to the membrane 2106 with a shield hinge point 2120.

The shield hinge point 2120 can include a shield hinge point front surface 2122 facing the same general direction as the shield front surface 2108. The shield hinge point 2120 can further include a shield hinge point back surface 2124 generally facing the same direction as the shield back surface 2110.

Furthermore, the membrane 2106 can be coupled to the shaft 2104 with a shaft hinge point 2128. The shaft hinge point 2128 is shown having a shaft hinge point front surface 2130 generally facing the same direction as the shield front surface 2108. The shaft hinge point 2128 can also include a shaft hinge point back surface 2132 generally facing the same direction as the shield back surface 2110.

Between the shaft hinge point front surface 2130 and the shield hinge point front surface 2122, the membrane 2106 can include a membrane front surface 2136 exposed to the front of the pacifier system 2100. Likewise, between the shaft hinge point back surface 2132 and the shield hinge point back surface 2124, the membrane 2106 can include a membrane back surface 2138 exposed to the back of the pacifier system 2100.

The shaft 2104 can be comprised of a shaft outer member 2142 and a shaft inner member 2144. The shaft hinge point 2128, coupling the membrane 2106 to the shaft 2104, can couple the membrane 2106 to the shaft outer member 2142.

The shaft 2104 can further comprise a nipple 2146 and a handle 2148. The shaft inner member 2144 can be in direct contact only with the nipple 2146 near the front of the pacifier system 2100. Furthermore, the shaft inner member 2144 can be in direct contact with the handle 2148 near the back of the pacifier system 2100.

The shaft outer member 2142 can transition from and extend between the nipple 2146 near the front of the pacifier system 2100 and the shaft hinge point 2128 of the membrane 2106. The shaft inner member 2144 can be floating within the shaft outer member 2142 and the membrane 2106 by extending from the nipple 2146, past the shield back surface 2110 without contacting the shaft outer member 2142, the membrane 2106, or the shield 2102. The shaft inner member 2144 is therefore supported by the nipple 2146 only.

The shaft inner member 2144 can extend from the nipple 2146 up to and include the handle 2148. The shaft outer member 2142 can be hollow, except for the shaft inner member 2144 running therethrough, for increased comfort, pliability, and reduced material during manufacturing, which helps to reduce costs.

The handle 2148 and the shaft inner member 2144 are solid allowing for increased structural rigidity. The handle 2148 can be a protrusion handle with a protrusion 2150 extending away from and around the shaft inner member 2144.

The handle 2148 can be pressed forward toward the shield 2102 placing the pacifier system 2100 in the extended configuration or pulled back away from the shield 2102 placing the pacifier system 2100 in the retracted configuration. As is depicted in the extended configuration, the shaft hinge point front surface 2130 together with the membrane front surface 2136 is extended forward past the shield front surface 2108.

When the pacifier system 2100 is converted from the extended configuration to the retracted configuration, the membrane 2106 will invert as the shaft 2104 is moved toward the back. The conversion from the extended configuration to the retracted configuration can be accomplished as a step rather than a smooth slide.

That is the shaft 2104 can be pressed until it reaches a resistance threshold, after which, the shaft 2104 will move forward with little effort at all. It has been discovered that providing the membrane 2106 with the step style movement improves on prior developments that included a sliding action by allowing the pacifier system 2100 to either be in the retracted configuration or in the extended configuration but not in a slidable position therebetween.

Providing a step style movement improves cleanliness by reducing the likelihood that the shaft 2104 will partially move when unintended. Furthermore, the pacifier system 2100 will tend not to convert to the extended configuration when the pacifier system 2100 is dropped for example, but can easily do so when the handle 2148 is intentionally pushed and the resistance threshold is overcome.

Yet furthermore, the membrane 2106 has been discovered to reduce part count by providing a travel stop for the shaft 2104 when it is pushed into the extended configuration. That is, the membrane 2106 can have a more or less fixed size, and when the handle 2148 is pushed, the shaft 2104 will travel forward until the membrane 2106 is fully inverted with the membrane front surface 2136 exposed.

When fully inverted, the membrane 2106 will no longer allow the shaft 2104 to travel forward. This improvement unexpectedly reduces the part count of previous developments which relied on stopper members or similar structures to prevent forward or rearward travel of the shaft 2104.

The membrane 2106 can be inverted when the surfaces of the membrane are put in opposite positions. That is, when the membrane 2106 is in the retracted configuration having the membrane front surface 2136 facing the shaft outer member 2142 and the shaft inner member 2144 together with the membrane back surface 2138 facing away from the shaft 2104, an inverted membrane 2106 would have the membrane back surface 2138 facing the shaft inner member 2144 of the shaft 2104 and the membrane front surface 2136 facing away from the shaft inner member 2144 of the shaft 2104 as is depicted in the extended configuration.

Figure 22:
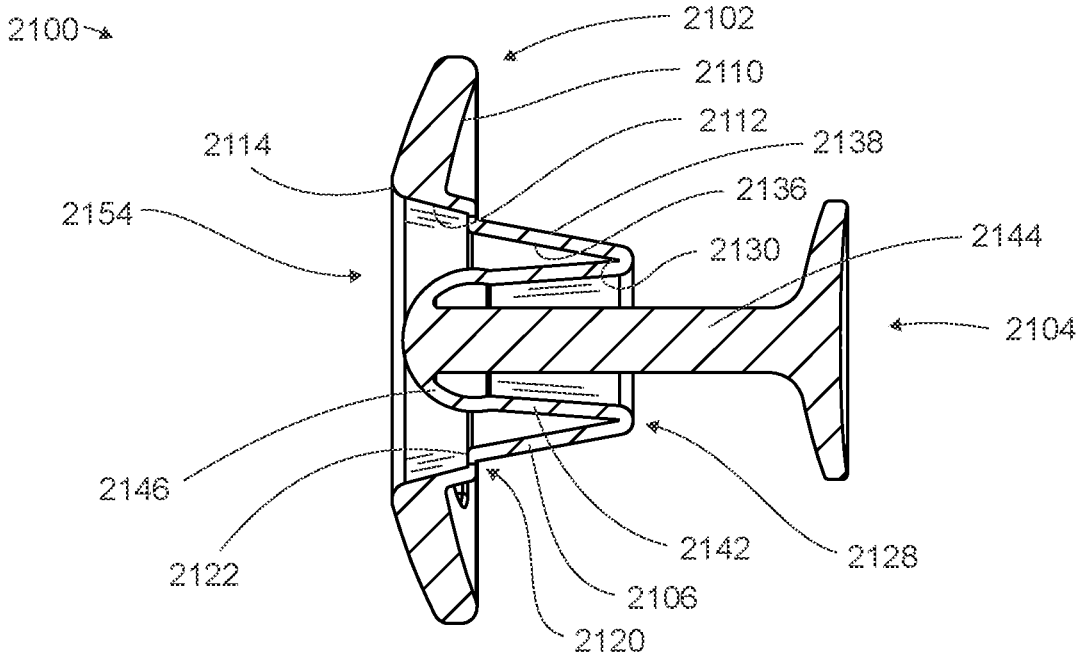
FIG. 22 is a cross-sectional view of the pacifier system of FIG. 21 in the retracted configuration.

Conversely, when the membrane 2106 is in the extended configuration having the membrane front surface 2136 facing away from the shaft inner member 2144 and the membrane back surface 2138 facing toward the shaft inner member 2144, an inverted membrane 2106 would have the membrane back surface 2138 facing away from the shaft 2104 and the membrane front surface 2136 facing toward the shaft 2104 as is depicted in the retracted configuration of FIG. 22, for example.

Pulling the handle 2148 backward can retract the shaft outer member 2142 including the nipple 2146 into a storage cavity 2154. The storage cavity 2154 can be comprised of the shield interior surface 2112 and the membrane front surface 2136.

As shown, in the extended configuration, the shaft hinge point 2128 can extend away from the shaft outer member 2142 and toward the shield 2102 forming an angled step ending in the membrane front surface 2136. The membrane 2106 and the shaft outer member 2142 can be narrowed toward the nipple 2146 and wider toward the shield hinge point 2120, which connects the membrane 2106 between the shield interior surface 2112 and the shield back surface 2110. The shield interior surface 2112 can conversely can be angled to be narrower at the shield hinge point 2120 and widen toward the shield rounded edge 2114.

The conversion between the extended configuration and the retracted configuration can be achieved by inverting the membrane 2106 which requires folding at the shield hinge point 2120 and the shaft hinge point 2128. The material thickness of both the shield hinge point 2120 and the shaft hinge point 2128 is thinner with respect to the rest of the membrane 2106 in order to create a hinge line where the material naturally wants to fold. As shown, the shield hinge point 2120 and the shaft hinge point 2128 can be about half of the cross-sectional thickness of the other portions of the membrane 2106 between the membrane front surface 2136 and the membrane back surface 2138.

The shield hinge point 2120 is shown extend from the membrane 2106 to contact the shield back surface 2110. In the extended configuration, the membrane 2106 can be parallel to the shield back surface 2110.

The pacifier system 2100 can be formed as a single piece of material such as silicon, latex, rubber, or other appropriate material. Being formed as a single piece should be understood to mean that the pacifier system 2100 can be formed without adhesive seams or mechanical coupling components such as threaded portions or pins.

One such method of forming as a single piece can be through injection molding during which all elements of the pacifier system 2100 can be formed with one single piece of material. The pacifier system 2100 can have characteristics of being formed by injection molding including seams created by an injection mold and surface irregularities created by injection ports.

Referring now to FIG. 22, therein is shown a cross-sectional view of the pacifier system 2100 of FIG. 21 in the retracted configuration. The storage cavity 2154 can extend to house the shaft outer member 2142 together with the nipple 2146 when the pacifier system 2100 is in the retracted configuration. The shield rounded edge 2114 can be extended further forward or further past the nipple 2146 for protection.

The shield interior surface 2112 can extend between the shield hinge point front surface 2122 to the shield rounded edge 2114. The storage cavity 2154 can be wider near the shield interior surface 2112 and narrower near the membrane front surface 2136.

It has been discovered that the wider storage cavity 2154 near the shield interior surface 2112 allows for the nipple 2146 to be concealed without contacting the shield interior surface 2112 or any portion of the storage cavity 2154 while still allowing the shaft hinge point front surface 2130 to be concealed within the narrower portion of the storage cavity 2154. No contact between the storage cavity 2154 and the nipple 2146 or the shaft outer member 2142 is shown except for the contact between the shaft hinge point front surface 2130 and the shaft outer member 2142.

It has been discovered that utilizing the membrane 2106 to form the storage cavity 2154 has many unforeseen improvements because the membrane 2106 can be used to precisely determine the distance the shaft 2104 travels, no stopper member is needed to stop the nipple 2146 from retracting too far. This further reduces unsanitary contact between elements and simultaneously reduces manufacturing complexity and part count. The membrane 2106 is shown with the membrane back surface 2138 exposed and the membrane front surface 2136 forming a large portion of the storage cavity 2154.

The membrane 2106 can be inverted to provide the extended configuration by folding at the hinge points. The material thickness at the hinge points is thinner with respect to the rest of the membrane 2106 in order to create a hinge line where the material naturally wants to fold.

The shaft hinge point 2128 is shown extend out away from the shaft outer member 2142 and the shaft inner member 2144. The shield hinge point 2120 is shown extended away from and inline with the shield back surface 2110.

It is contemplated that the shaft hinge point 2128 can contact the entire perimeter of the shaft 2104, specifically the shaft outer member 2142. Likewise, the shield hinge point 2120 can contact the shield 2102 in an unbroken connection around the full perimeter of the membrane 2106.

Coupling the shaft 2104 to the shield 2102 with the membrane 2106 without holes therein provides the storage cavity 2154 for sanitary storage and protection of many elements of the pacifier system 2100 such as the nipple 2146 and the shaft 2104. The unbroken membrane 2106 extending around the shaft outer member 2142 and the shield 2102 can help isolate the storage cavity 2154 from the environment by forming an environmental barrier with the membrane back surface 2138.

Figure 23:
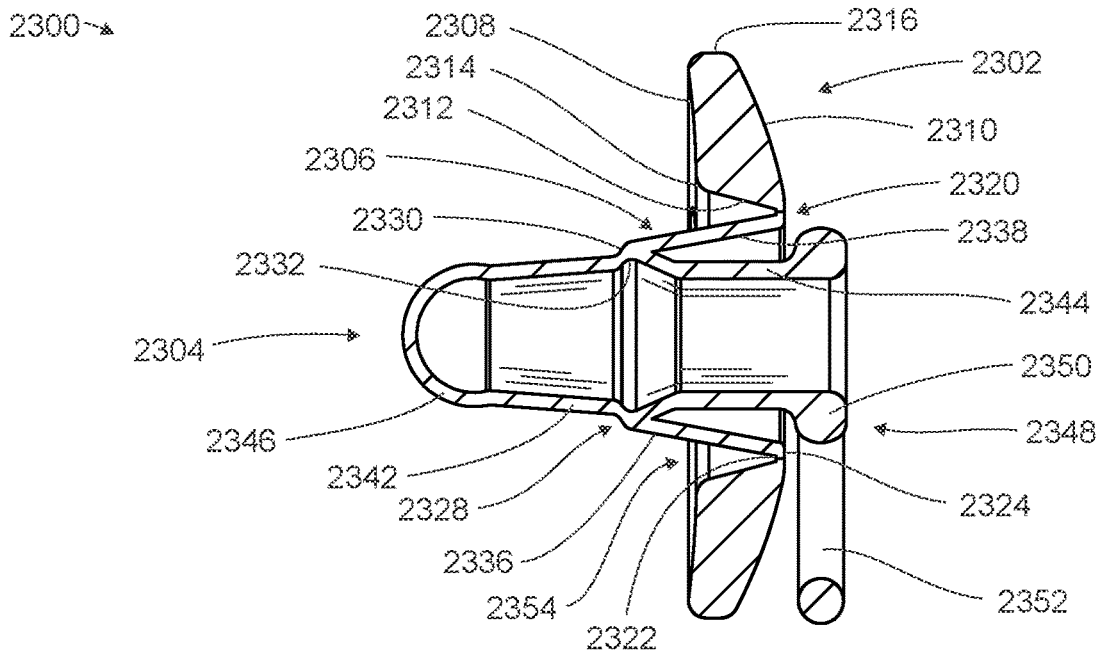
FIG. 23 is a cross-sectional view of the pacifier system in a fifth embodiment and in the extended configuration.

Referring now to FIG. 23, therein is shown a cross-sectional view of the pacifier system 2300 in a fifth embodiment and in the extended configuration. The pacifier system 2300 is shown having a shield 2302 coupled to a shaft 2304 with a membrane 2306.

The shield 2302 can include a shield front surface 2308 and a shield back surface 2310 opposite the shield front surface 2308. The shield front surface 2308 can be the portion of the pacifier system 2300 facing a user while being use orally.

The shield back surface 2310 can be the portion of the pacifier system 2300 facing away from the user while being used orally. The shield 2302 can generally divide the pacifier system 2300 between a front and a back.

The shield back surface 2310 and the shield front surface 2308 can both transition into a shield interior surface 2312. Between the shield interior surface 2312 and the shield front surface 2308, the shield 2302 can include a shield rounded edge 2314 for smoothly transitioning from the shield front surface 2308 to the shield interior surface 2312 and thereby provide greater comfort to the user.

The shield front surface 2308 and the shield back surface 2310 can further transition into a shield peripheral surface 2316. The shield peripheral surface 2316 is shown being rounded between the shield front surface 2308 and between the shield back surface 2310.

The shield 2302 and the shaft 2304 can be coupled to the membrane 2306 with hinge points. More particularly, the shield 2302 can be coupled to the membrane 2306 with a shield hinge point 2320.

The shield hinge point 2320 can include a shield hinge point front surface 2322 facing the same general direction as the shield front surface 2308. The shield hinge point 2320 can further include a shield hinge point back surface 2324 generally facing the same direction as the shield back surface 2310.

Furthermore, the membrane 2306 can be coupled to the shaft 2304 with a shaft hinge point 2328. The shaft hinge point 2328 is shown having a shaft hinge point front surface 2330 generally facing the same direction as the shield front surface 2308. The shaft hinge point 2328 can also include a shaft hinge point back surface 2332 generally facing the same direction as the shield back surface 2310.

Between the shaft hinge point front surface 2330 and the shield hinge point front surface 2322, the membrane 2306 can include a membrane front surface 2336 exposed to the front of the pacifier system 2300. Likewise, between the shaft hinge point back surface 2332 and the shield hinge point back surface 2324, the membrane 2306 can include a membrane back surface 2338 exposed to the back of the pacifier system 2300.

The coupling of the membrane 2306 to the shaft 2304 by way of the shaft hinge point 2328 can bifurcate the shaft 2304 into a shaft front portion 2342 and a shaft back portion 2344. The shaft front portion 2342 can extend from the shaft hinge point 2328 up to and include a nipple 2346.

The shaft front portion 2342 can be narrowed down from the shaft hinge point 2328 and have an angle substantially coplanar with membrane back surface 2338 when in the extended configuration. The narrowing of the shaft front portion 2342 from the membrane 2306 to the nipple 2346 can accommodate a larger nipple 2346 for larger mouths. The widening of the shaft front portion 2342 near the shaft hinge point 2328 can further provide a larger surface for larger mouths.

The shaft back portion 2344 can extend from the shaft hinge point 2328 up to and include a handle 2348. The shaft 2304 can be hollow for increased comfort, pliability, and reduced material during manufacturing, which helps to reduce costs. The handle 2348 is also shown as open-ended allowing the inside of the shaft 2304 to be accessible from the handle 2348.

The handle 2348 can be a protrusion handle with a protrusion 2350 extending away from and around the shaft 2304. Furthermore, the handle 2348 can include a ring 2352 directly attached to the protrusion 2350.

The ring 2352 can be formed as a single piece with the protrusion 2350, in which case the ring 2352 would bend when moved from its resting position. Other contemplated embodiments can include a hinged ring which would pivot when moved from its resting position.

The handle 2348 can be pressed forward toward the shield 2302 placing the pacifier system 2300 in the extended configuration or pulled back away from the shield 2302 placing the pacifier system 2300 in the retracted configuration. As is depicted in the extended configuration, the shaft hinge point front surface 2330 together with the membrane front surface 2336 is extended forward past the shield front surface 2308.

When the pacifier system 2300 is converted from the extended configuration to the retracted configuration, the membrane 2306 will invert as the shaft 2304 is moved toward the back. The conversion from the extended configuration to the retracted configuration can be accomplished as a step rather than a smooth slide.

That is the shaft 2304 can be pressed until it reaches a resistance threshold, after which, the shaft 2304 will move forward with little effort at all. It has been discovered that providing the membrane 2306 with the step style movement improves on prior developments that included a sliding action by allowing the pacifier system 2300 to either be in the retracted configuration or in the extended configuration but not in a slidable position therebetween.

Providing a step style movement improves cleanliness by reducing the likelihood that the shaft 2304 will partially move when unintended. Furthermore, the pacifier system 2300 will tend not to convert to the extended configuration when the pacifier system 2300 is dropped for example, but can easily do so when the handle 2348 is intentionally pushed and the resistance threshold is overcome.

Yet furthermore, the membrane 2306 has been discovered to reduce part count by providing a travel stop for the shaft 2304 when it is pushed into the extended configuration. That is, the membrane 2306 can have a more or less fixed size, and when the handle 2348 is pushed, the shaft 2304 will travel forward until the membrane 2306 is fully inverted with the membrane front surface 2336 exposed.

When fully inverted, the membrane 2306 will no longer allow the shaft 2304 to travel forward. This improvement unexpectedly reduces the part count of previous developments which relied on stopper members or similar structures to prevent forward or rearward travel of the shaft 2304.

The membrane 2306 can be inverted when the surfaces of the membrane are put in opposite positions. That is, when the membrane 2306 is in the retracted configuration having the membrane front surface 2336 facing the shaft 2304 and the membrane back surface 2338 facing away from the shaft 2304, an inverted membrane 2306 would have the membrane back surface 2338 facing the shaft 2304 and the membrane front surface 2336 facing away from the shaft 2304 as is depicted in the extended configuration.

Figure 24:
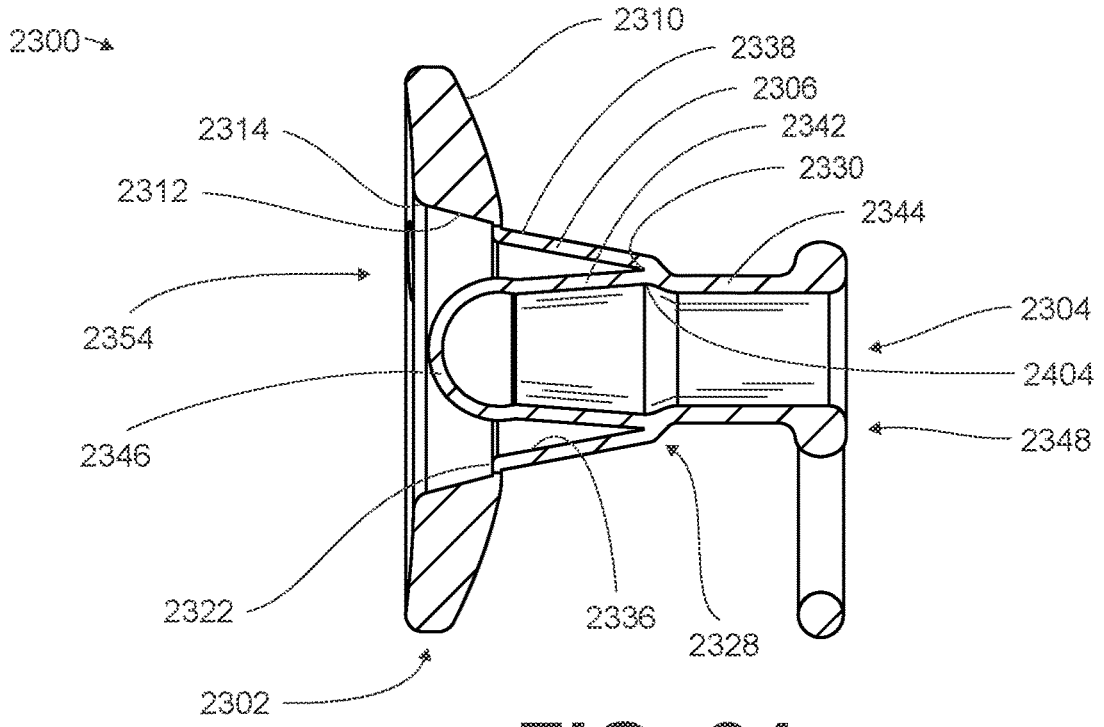
FIG. 24 is a cross-sectional view of the pacifier system of FIG. 23 in the retracted configuration.

Conversely, when the membrane 2306 is in the extended configuration having the membrane front surface 2336 facing away from the shaft 2304 and the membrane back surface 2338 facing toward the shaft 2304, an inverted membrane 2306 would have the membrane back surface 2338 facing away from the shaft 2304 and the membrane front surface 2336 facing toward the shaft 2304 as is depicted in the retracted configuration of FIG. 24, for example.

Pulling the handle 2348 backward can retract the shaft front portion 2342 including the nipple 2346 into a storage cavity 2354. The storage cavity 2354 can be comprised of the shield interior surface 2312 and the membrane front surface 2336. As shown, in the extended configuration, the shaft hinge point 2328 can extend away from the shaft 2304 and toward the shield 2302 forming an angled step ending in the membrane front surface 2336.

The conversion between the extended configuration and the retracted configuration can be achieved by inverting the membrane 2306 which requires folding at the shield hinge point 2320 and the shaft hinge point 2328. The material thickness of the shield hinge point 2320 is thinner with respect to the rest of the membrane 2306 in order to create a hinge line where the material naturally wants to fold. As shown, the shield hinge point 2320 can be about half of the cross-sectional thickness of the other portions of the membrane 2306 between the membrane front surface 2336 and the membrane back surface 2338.

The shield hinge point 2320 is shown angled and extend away from and in line with the shield back surface 2310 to contact the membrane 2306. In the extended configuration, the membrane 2306 can narrow toward the shaft front portion 1542 and widen near the shield hinge point 1520.

The shaft back portion 2344 can be coupled between the shaft hinge point 2328 and the membrane back surface 2338 allowing the shaft back portion 2344 to angle up toward the membrane 2306 and creating a bulge in the shaft 2304 when in the extended configuration. The shaft 2304 can decrease in cross-sectional thickness as it stretches to reach the membrane 2306 in the extended configuration.

The bulge in the shaft 2304 can be fully extended beyond the shield front surface 2308 while beginning near the shield rounded edge 2314. The pacifier system 2300 can be formed as a single piece of material such as silicon, latex, rubber, or other appropriate material. Being formed as a single piece should be understood to mean that the pacifier system 2300 can be formed without adhesive seams or mechanical coupling components such as threaded portions or pins.

One such method of forming as a single piece can be through injection molding during which all elements of the pacifier system 2300 can be formed with one single piece of material. The pacifier system 2300 can have characteristics of being formed by injection molding including seams created by an injection mold and surface irregularities created by injection ports.

Referring now to FIG. 24, therein is shown a cross-sectional view of the pacifier system 2300 of FIG. 23 in the retracted configuration. The storage cavity 2354 can extend to house the shaft front portion 2342 together with the nipple 2346 when the pacifier system 2300 is in the retracted configuration. The shield rounded edge 2314 can be extended further forward or further past the nipple 2346 for protection.

The shield interior surface 2312 can extend between the shield hinge point front surface 2322 to the shield rounded edge 2314. The storage cavity 2354 can be wider near the shield interior surface 2312 and narrower near the membrane front surface 2336. It has been discovered that the wider storage cavity 2354 near the shield interior surface 2312 allows for the nipple 2346 to be concealed without contacting the shield interior surface 2312 or any portion of the storage cavity 2354 while still allowing the shaft hinge point front surface 2330 to be concealed within the narrower portion of the storage cavity 2354. No contact between the storage cavity 2354 and the nipple 2346 or the shaft 2304 is shown except for the contact between the shaft hinge point front surface 2330 and the shaft front portion 2342.

It has been discovered that utilizing the membrane 2306 to form the storage cavity 2354 has many unforeseen improvements because the membrane 2306 can be used to precisely determine the distance the shaft 2304 travels, no stopper member is needed to stop the nipple 2346 from retracting too far. This further reduces unsanitary contact between elements and simultaneously reduces manufacturing complexity and part count.

The membrane 2306 is shown with the membrane back surface 2338 exposed and the membrane front surface 2336 forming a large portion of the storage cavity 2354. The membrane 2306 is shown bisecting the shaft 2304 at the shaft hinge point 2328 between the handle 2348 and the nipple 2346 to create the shaft front portion 2342 and the shaft back portion 2344.

The interior surface of the shaft 2304 is shown having an indentation 2404 at the point where the shaft hinge point 2328 contacts the shaft 2304. The indentation 2404 can enable the shaft 2304 to stretch and reduce cross-sectional thickness when in the extended configuration.

The membrane 2306 can be inverted to provide the extended configuration by folding at the hinge points. The material thickness at the hinge points is thinner with respect to the rest of the membrane 2306 in order to create a hinge line where the material naturally wants to fold.

The shaft hinge point 2328 is shown angled and extend over the shaft front portion 2342 toward the shield 2302. The shield hinge point 2320 is shown extended away from and in line with the shield back surface 2310.

It is contemplated that the shaft hinge point 2328 can contact the entire perimeter of the shaft 2304, and likewise, the shield hinge point 2320 can contact the shield 2302 in an unbroken connection around the full perimeter of the membrane 2306. Coupling the shaft 2304 to the shield 2302 with the membrane 2306 without holes therein provides the storage cavity 2354 for sanitary storage and protection of many elements of the pacifier system 2300 such as the nipple 2346 and the shaft 2304. The unbroken membrane 2306 extending around the shaft 2304 and the shield 2302 can help isolate the storage cavity 2354 from the environment by forming an environmental barrier with the membrane back surface 2338.

Figure 25:
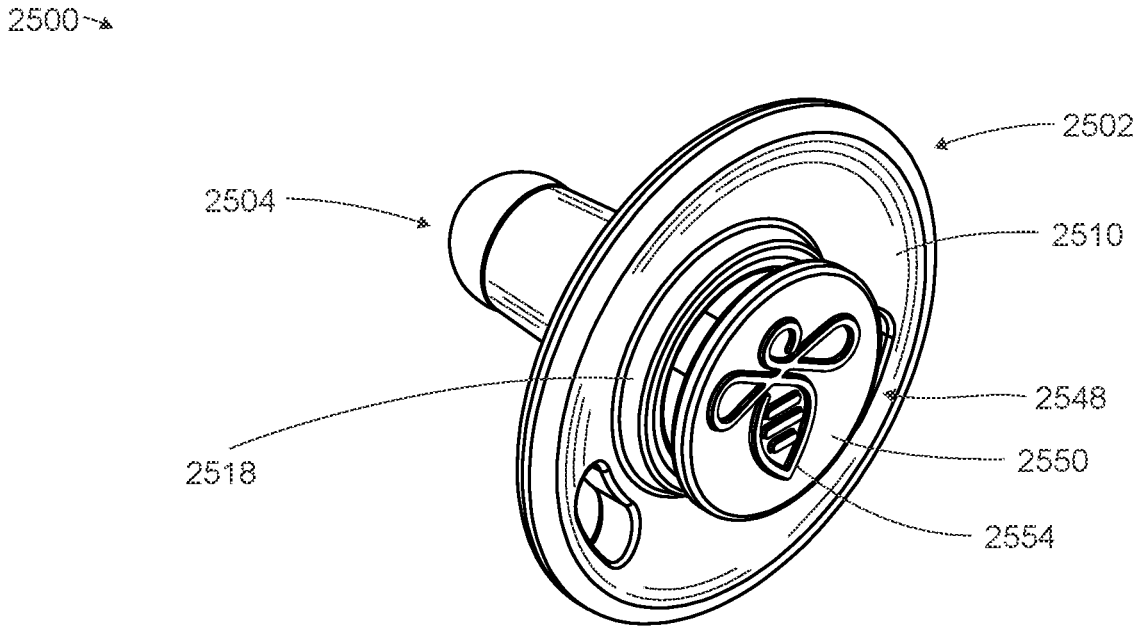
FIG. 25 is a back isometric view of the pacifier system in a sixth embodiment and in the extended configuration.

Referring now to FIG. 25, therein is shown a back isometric view of the pacifier system 2500 in a sixth embodiment and in the extended configuration. The pacifier system 2500 is depicted having a shield 2502 and a shaft 2504. The shield 2502 can include a shield back surface 2510 including a bump stop 2518 for preventing the forward movement of the shaft 2504 when being placed into the extended configuration.

The shaft 2504 can include a handle 2548, such as a protrusion handle, which can align with the bump stop 2518. As the shaft 2504 is pressed forward toward the shield 2502, the handle 2548 can contact the bump stop 2518 if pressed too hard and preserve a membrane coupling the shield 2502 to the shaft 2504.

The handle 1548 can be a circular handle with a flat back portion 2550. The flat back portion 2550 can further include a raised element 2554 providing texture, ready identification, and a pleasing design.

Figure 26:
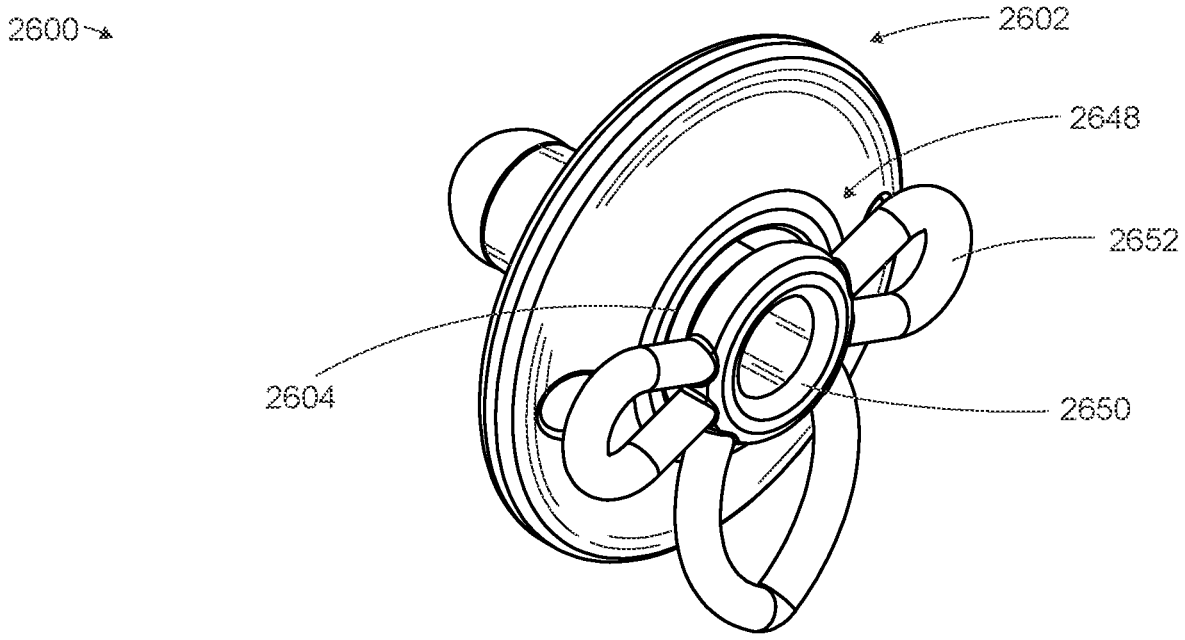
FIG. 26 is a back isometric view of the pacifier system in a seventh embodiment and in the extended configuration.

Referring now to FIG. 26, therein is shown a back isometric view of the pacifier system 2600 in a seventh embodiment and in the extended configuration. The pacifier system 2600 is depicted having a shield 2602 and a shaft 2604. The shaft 2604 can include a handle 2648 including a protrusion 1550 and a triple ring 1552. The triple ring 1552 can extend from the protrusion 1550 in three directions and away from the shaft 1504 for increased grip, which is important when users are still developing fine motor skills.

Figure 27:
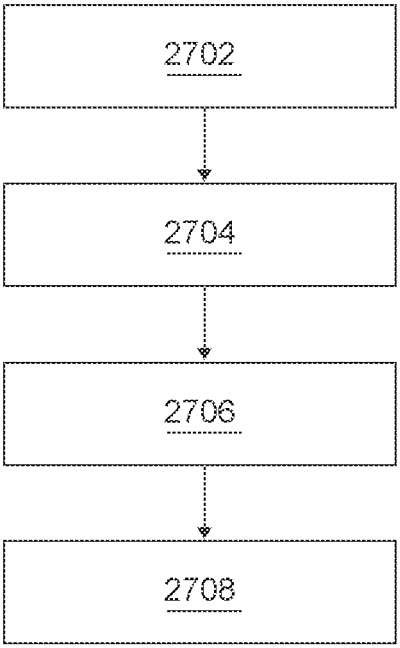
FIG. 27 is a flow chart of a method of manufacturing the pacifier system.

Referring now to FIG. 27, therein is shown a flow chart of a method of manufacturing the pacifier system 100 of FIG. 1. The method can include: forming a shield in a block 2702; forming a shaft coupled to the shield in a block 2704; forming a nipple coupled to the shaft in a block 2706; and forming a membrane coupled between the shield and the shaft, the membrane providing a retracted configuration creating a storage cavity for the nipple based on the shaft being pulled away from the shield, and the membrane providing an extended configuration with the nipple exposed and extended past the shield based on the shaft being pressed toward the shield and the membrane inverting from the retracted configuration in a block 2708.

In one or more contemplated embodiment, the pacifier system can comprise: a shield; a shaft coupled to the shield; a nipple coupled to the shaft; and a membrane coupled between the shield and the shaft, the membrane forming a storage cavity for the nipple based on the shaft being pulled away from the shield, and the nipple being exposed based on the shaft being pressed toward the shield and the membrane inverting. Wherein the shield includes a shield interior surface, and the shield interior surface forming a portion of the storage cavity; the membrane is coupled to the shaft with a shaft hinge point having a smaller cross-sectional thickness than the membrane; the membrane is coupled to the shield with a shield hinge point having a smaller cross-sectional thickness than the membrane; and further comprising a handle coupled to the shaft.

In one or more contemplated embodiment, the pacifier system can comprise: a shield; a shaft coupled to the shield, the shaft having a nipple and a handle; and a membrane coupled between the shield and the shaft, the membrane coupled to the shaft between the nipple and the handle, the membrane forming a storage cavity for the nipple based on the handle being pulled away from the shield, and the nipple being exposed based on the handle being pressed toward the shield and the membrane inverting. Wherein the handle is a protrusion handle extended radially away from the shaft; the system of claim 6 wherein the shield, the shaft, and the membrane are formed as a single piece; the system of claim 6 wherein the shield, the shaft, and the membrane are formed of silicone; and the system of claim 6 wherein the membrane is coupled to a shield back surface with a shield hinge point.

A method of manufacturing one or more contemplated embodiment of the pacifier system can comprise: forming a shield; forming a shaft coupled to the shield; forming a nipple coupled to the shaft; and forming a membrane coupled between the shield and the shaft, the membrane forming a storage cavity for the nipple based on the shaft being pulled away from the shield, and the nipple being exposed based on the shaft being pressed toward the shield and the membrane inverting. Wherein forming the shield includes a forming shield interior surface, and the shield interior surface providing a portion of the storage cavity; forming the membrane includes forming the membrane coupled to the shaft with a shaft hinge point having a smaller cross-sectional thickness than the membrane; forming the membrane includes forming the membrane coupled to the shield with a shield hinge point having a smaller cross-sectional thickness than the membrane; and further comprising forming a handle coupled to the shaft.

The method of manufacturing one or more contemplated embodiment of the pacifier system can further comprise: forming the shaft having a nipple and a handle; and forming the membrane coupled to the shaft between the nipple and the handle, the membrane providing the storage cavity for the nipple based on the handle being pulled away from the shield, and the nipple being exposed based on the handle being pressed toward the shield and the membrane inverting. Wherein forming the handle includes forming a protrusion handle extended radially away from the shaft; forming the shield, the shaft, and the membrane includes forming the shield, the shaft, and the membrane formed as a single piece; forming the shield, the shaft, and the membrane includes forming the shield, the shaft, and the membrane of silicone; and forming the membrane includes forming the membrane coupled to a shield back surface with a shield hinge point.

Thus, it has been discovered that the pacifier system furnishes important and heretofore unknown and unavailable solutions, capabilities, and functional aspects. The resulting configurations are straightforward, sanitary, simple, and cost-effective, uncomplicated, and effective, and can be implemented by adapting known components for ready, efficient, and economical manufacturing, application, and utilization.

While the pacifier system has been described in conjunction with a specific best mode, it is to be understood that many alternatives, modifications, and variations will be apparent to those skilled in the art in light of the preceding description. Accordingly, it is intended to embrace all such alternatives, modifications, and variations, which fall within the scope of the included claims. All matters set forth herein or shown in the accompanying drawings are to be interpreted in an illustrative and non-limiting sense.

What is claimed is:

1. A pacifier system comprising:

a shield; a shaft coupled to the shield;

a nipple coupled to the shaft; and a membrane coupled between the shield and the shaft, the membrane providing a retracted configuration creating a storage cavity for the nipple based on the shaft being pulled away from the shield, and the membrane providing an extended configuration with the nipple exposed and extended past the shield based on the shaft being pressed toward the shield and the membrane inverting from the retracted configuration;

wherein the membrane is coupled to the shaft with a shaft hinge point having a smaller cross-sectional thickness than the membrane.

2. The system of claim 1 wherein the shaft has a reduced cross-sectional thickness of material forming the shaft near the membrane when in the extended configuration.

3. A pacifier system comprising:

a shield;

a shaft coupled to the shield, the shaft having a nipple and a handle; and a membrane coupled between the shield and the shaft, the membrane coupled to the shaft between the nipple and the handle, the membrane providing a retracted configuration creating a storage cavity for the nipple based on the handle being pulled away from the shield, and the membrane providing an extended configuration with the nipple exposed and extended past the shield based on the handle being pressed toward the shield and the membrane inverting from the retracted configuration;

wherein the membrane is coupled to the shaft with a shaft hinge point having a smaller cross-sectional thickness than the membrane.

4. The system of claim 3 wherein the membrane includes a protuberance pushing the membrane out and away from the shaft in the extended configuration.

5. The system of claim 3 wherein the shield, the shaft, and the membrane are formed of a single piece of material.

6. The system of claim 3 wherein the shield includes a bump stop for preventing forward movement of the shaft when being placed into the extended configuration.

7. The system of claim 3 wherein the handle includes a protrusion extended radially away from the shaft or the protrusion coupled to a ring.

8. A method of manufacturing a pacifier system comprising:

forming a shield;

forming a shaft coupled to the shield;

forming a nipple coupled to the shaft; and forming a membrane coupled between the shield and the shaft, the membrane providing a retracted configuration creating a storage cavity for the nipple based on the shaft being pulled away from the shield, and the membrane providing an extended configuration with the nipple exposed and extended past the shield based on the shaft being pressed toward the shield and the membrane inverting from the retracted configuration;

wherein forming the membrane includes forming the membrane coupled to the shaft with a shaft hinge point having a smaller cross-sectional thickness than the membrane.

9. The method of claim 8 wherein forming the shaft includes forming the shaft having a reduced cross-sectional thickness of material forming the shaft near the membrane when in the extended configuration.

10. The method of claim 8 wherein:

forming the shaft includes forming the shaft having a handle; and forming the membrane includes forming the membrane coupled to the shaft between the nipple and the handle, the membrane providing the retracted configuration based on the handle being pulled away from the shield, and the membrane providing the extended configuration based on the handle being pressed toward the shield.

11. The method of claim 10 wherein forming the membrane includes forming the membrane having a protuberance pushing the membrane out and away from the shaft in the extended configuration.

12. The method of claim 10 wherein forming the shield, the shaft, and the membrane include forming the shield, the shaft, and the membrane of a single piece of material.

13. The method of claim 10 wherein forming the shield includes forming the shield having a bump stop preventing forward movement of the shaft when being placed into the extended configuration.

14. The method of claim 10 wherein forming the shaft includes forming the handle having a protrusion extended radially away from the shaft or the protrusion coupled to a ring.

* * * * *